US010307926B2

(12) United States Patent
Aminpour

(10) Patent No.: US 10,307,926 B2
(45) Date of Patent: Jun. 4, 2019

(54) AUTOMATED FABRIC PICKING

(71) Applicant: Amazon Technologies, Inc., Seattle, WA (US)

(72) Inventor: Rouzbeh Safavi Aminpour, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 553 days.

(21) Appl. No.: 15/069,849

(22) Filed: Mar. 14, 2016

(65) Prior Publication Data

US 2017/0259445 A1 Sep. 14, 2017

(51) Int. Cl.
*B26D 5/00* (2006.01)
*B65H 29/24* (2006.01)
(Continued)

(52) U.S. Cl.
CPC ..... *B26D 5/005* (2013.01); *B26D 5/007* (2013.01); *B65H 5/222* (2013.01); *B65H 29/241* (2013.01); *B65H 29/32* (2013.01); *B65H 31/3018* (2013.01); *B65H 39/00* (2013.01); *A41H 43/0292* (2013.01); *B26D 2005/002* (2013.01); *B65H 2406/366* (2013.01); *B65H 2511/10* (2013.01); *B65H 2511/16* (2013.01); *B65H 2515/10* (2013.01); *B65H 2515/342* (2013.01);
(Continued)

(58) Field of Classification Search
CPC .... B65H 29/222; B65H 29/241; B65H 29/32; B65H 2406/366; B65H 2701/174; B65H 5/222; B26D 5/007
USPC ..... 700/130, 134, 135
See application file for complete search history.

(56) References Cited

U.S. PATENT DOCUMENTS 3,574,409 A * 4/1971 Furstenberg ..... B65G 53/06 406/120
4,178,820 A 12/1979 Gerber
(Continued)

FOREIGN PATENT DOCUMENTS

WO 2016/033367 3/2016

OTHER PUBLICATIONS

U.S. Appl. No. 14/970,840, filed Dec. 16, 2015, Final Office Action dated Feb. 24, 2017.
(Continued)

*Primary Examiner* — Nathan E Durham
(74) *Attorney, Agent, or Firm* — Eversheds Sutherland (US) LLP

(57) ABSTRACT

Aspects of automated fabric picking are described. In one embodiment, a system includes a textile cutter including a tabletop upon which textile panels can be cut out from a textile sheet, a textile panel picker, and a computing device. The textile panel picker includes a flexible transport tube, a transport tube transfer arm to position the flexible transport tube over the tabletop and the textile panels, a textile hopper to collect the textile panels, and a pneumatic pump assembly to evacuate air from the textile hopper and through the flexible transport tube. The computing device identifies and tracks the textile panels on the tabletop, directs the transport tube transfer arm to position the flexible transport tube over the textile panels, and directs the pneumatic pump assembly to generate suction to pull the textile panels through the flexible transport tube and into the textile hopper.

19 Claims, 11 Drawing Sheets

(51) Int. Cl.

| | |
|---|---|
| ***B65H 5/22*** | (2006.01) |
| ***B65H 29/32*** | (2006.01) |
| ***B65H 31/30*** | (2006.01) |
| ***B65H 39/00*** | (2006.01) |
| *A41H 43/02* | (2006.01) |

(52) U.S. Cl.
CPC .... *B65H 2553/42* (2013.01); *B65H 2701/174* (2013.01)

(56) References Cited

U.S. PATENT DOCUMENTS

| | | | | |
|---|---|---|---|---|
| 5,132,505 | A | 7/1992 | Zonneveld | |
| 5,172,326 | A | 12/1992 | Campbell, Jr. et al. | |
| 5,254,833 | A | 10/1993 | Okiyama | |
| 5,333,111 | A | 7/1994 | Chaiken | |
| 5,418,711 | A | 5/1995 | Pomerleau | |
| 5,709,506 | A | 1/1998 | Beard et al. | |
| 5,791,215 | A | 8/1998 | Morrison et al. | |
| 5,806,390 | A | 9/1998 | Pomerleau | |
| 5,867,392 | A | 2/1999 | Bousquet | |
| 5,975,743 | A * | 11/1999 | Bercaits | B26D 5/00 700/134 |
| 6,028,320 | A | 2/2000 | Uhling | |
| 6,173,211 | B1 | 1/2001 | Williams et al. | |
| 6,349,241 | B1 | 2/2002 | Peron et al. | |
| 6,502,489 | B2 | 1/2003 | Gerent | |
| 6,520,057 | B1 | 2/2003 | Steadman | |
| 6,807,289 | B2 | 10/2004 | Zink | |
| 6,836,694 | B1 | 12/2004 | Heinz | |
| 7,003,370 | B2 | 2/2006 | Rapoza | |
| 7,524,145 | B2 * | 4/2009 | Heinz | B65G 51/02 406/116 |
| 8,428,767 | B2 | 4/2013 | Tremoureux et al. | |
| 8,731,703 | B1 | 5/2014 | Lehrer et al. | |
| 8,755,925 | B2 * | 6/2014 | Regan | A43D 95/00 700/117 |
| 8,838,482 | B2 | 9/2014 | Schindler et al. | |
| 9,139,382 | B2 * | 9/2015 | Thorpe | B65G 51/02 |
| 2007/0107572 | A1 | 5/2007 | Pommier | |
| 2013/0144424 | A1 * | 6/2013 | Jarbouai | G06F 9/06 700/134 |
| 2013/0261785 | A1 | 10/2013 | Crary et al. | |
| 2014/0277663 | A1 | 9/2014 | Gupta et al. | |
| 2014/0277683 | A1 | 9/2014 | Gupta et al. | |
| 2015/0066189 | A1 | 3/2015 | Mulligan et al. | |

OTHER PUBLICATIONS

U.S. Appl. No. 14/970,840, filed Dec. 16, 2015, Response to Non-Final Office Action filed on Nov. 14, 2016.

U.S. Appl. No. 14/970,874, filed Dec. 16, 2015, Response to Non-Final Office Action filed on Nov. 9, 2016.

U.S. Appl. No. 14/970,840, filed Dec. 16, 2015, Office Action dated Aug. 16, 2016.

U.S. Appl. No. 14/970,874, filed Dec. 16, 2015, Office Action dated Aug. 11, 2016.

U.S. Appl. No. 15/069,855, filed Mar. 14, 2016, Non-Final Office Action dated May 19, 2017.

U.S. Appl. No. 14/970,840, filed Dec. 16, 2015, Notice of Allowance dated Jun. 2, 2017.

U.S. Appl. No. 14/970,874, filed Dec. 16, 2015, Notice of Allowance dated Mar. 27, 2017.

U.S. Appl. No. 14/970,840, filed Dec. 16, 2015, Notice of Allowance dated Jun. 26, 2017.

U.S. Appl. No. 14/970,840, filed Dec. 16, 2015, Response to Final Office Action dated Feb. 24, 2017.

U.S. Appl. No. 15/069,855, filed Mar. 14, 2016, Reponse to Non-Final Office Action dated May 19, 2017.

U.S. Appl. No. 15/187,272, filed Jun. 20, 2016, Response to Restriction/Election dated Mar. 6, 2017.

U.S. Appl. No. 15/187,272, filed Jun. 20, 2016, Restriction/Election dated Mar. 6, 2017.

PCT Patent Application PCT/US17/016802 filed on Feb. 7, 2017, Notification of Transmittal of The International Search Report and The Written Opinion of The International Searching Authority, or The Declaration dated May 10, 2017.

PCT Patent Application PCT/US17/020334 filed on Mar. 2, 2017, Notification of Transmittal of The International Search Report and The Written Opinion of The International Searching Authority, or The Declaration dated Jun. 8, 2017.

* cited by examiner

AUTOMATED FABRIC PICKING

CROSS-REFERENCE TO RELATED APPLICATIONS

This application is related to U.S. patent application Ser. No. 14/970,874, filed Dec. 16, 2015, titled "On Demand Apparel Manufacturing" ("the '874 application") and U.S. patent application Ser. No. 14/970,840, filed Dec. 16, 2015, titled "On Demand Apparel Panel Cutting" ("the '840 application"), the entire disclosure of each of which related applications is hereby fully incorporated herein by reference. This application is also related to U.S. patent application Ser. No. 15/069,855, filed on Mar. 14, 2016, titled "Continuous Feed Fabric Cutting", and U.S. patent application Ser. No. 15/069,867, filed on Mar. 14, 2016, titled "Organized Assembly Instruction Printing and Referencing", the entire disclosure of each of which related applications is hereby fully incorporated herein by reference.

BACKGROUND

The apparel manufacturing, retailing, and fitting industries include a diverse range of parties, such as designers, fabric manufacturers, apparel cutting and sewing workers, apparel retailers, tailors, and cleaners. The apparel manufacturing industry relies upon various resources, processes, and equipment to produce finished garments, accessories, footwear, etc. Generally, a process to manufacture a garment includes garment design, fabric production and/or printing, and panel cutting and sewing. Although automation has been applied to many apparel manufacturing processes, workers are still heavily relied upon to cut, pick, and sew together pieces of fabric to produce finished garments.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
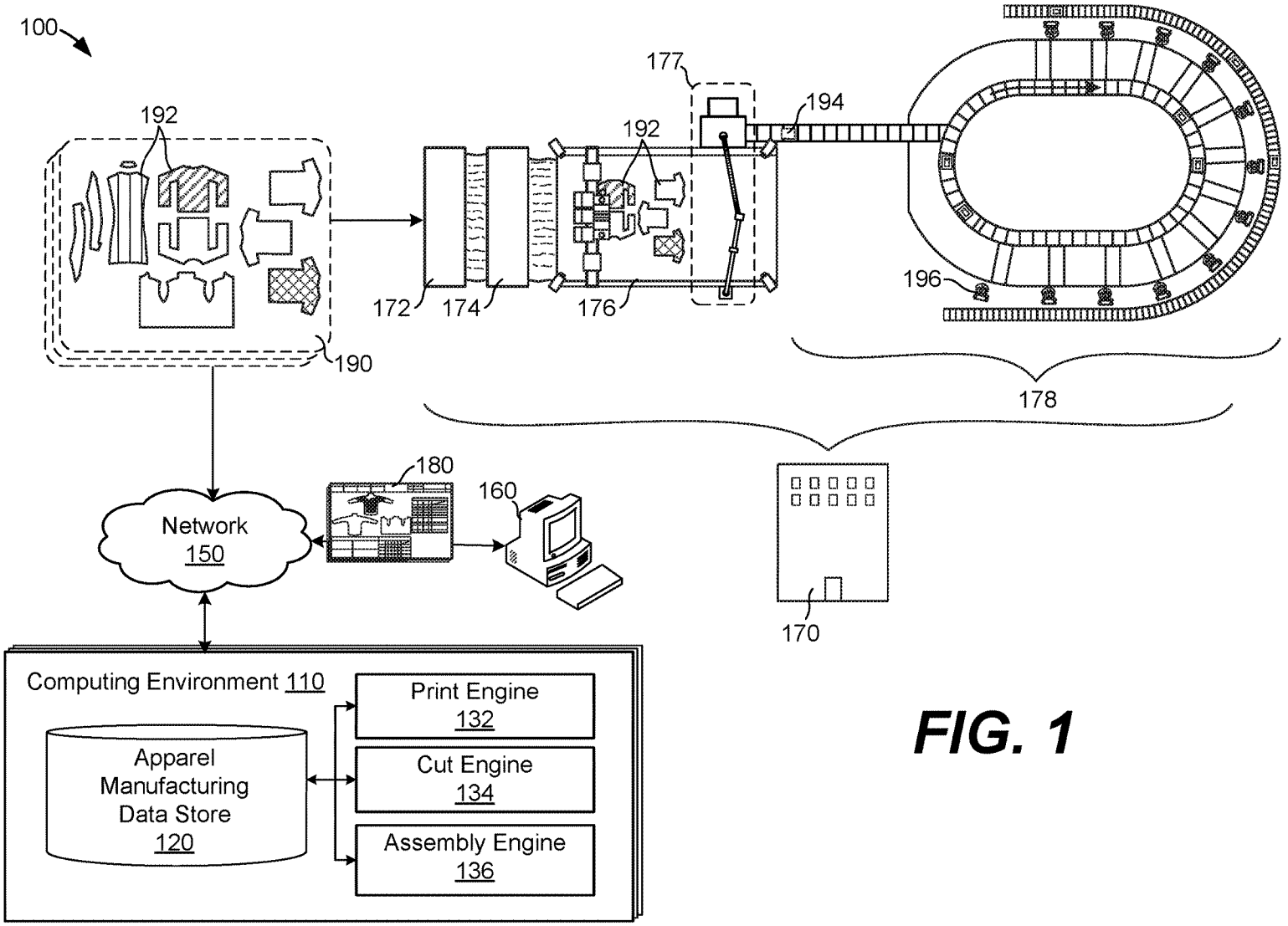
FIG. 1 illustrates a networked environment for automated panel printing, cutting, and picking according to various embodiments of the present disclosure.

Aspects of automated fabric picking using a system and method for printing, cutting, and assembling textile products are described herein. In one embodiment, the system includes a textile printer that prints patterns for textile panels on a textile sheet, a textile cutter including a tabletop upon which the textile panels can be cut out from the textile sheet, a textile panel picker to pick the textile panels off the tabletop, a textile production line, and a computing device that coordinates the operations of the system.

In one example, the computing environment is configured to receive one or more orders to purchase textile products, where each textile product is formed of one or more panels or pieces of fabric defined in a tech pack. The computing environment arranges the panels for the textile products onto a textile panel template for printing on a textile sheet using the textile printer. The panels can include print patterns, graphics, or other print features based on the designs for the textile products. Once the features for the panels are printed onto a textile sheet by the textile printer, the computing device directs the textile cutter to cut the textile panels out from the textile sheet.

Before the cut-out textile panels can be assembled on the textile production line, they are placed into one or more totes using the textile panel picker. The textile panel picker embodiments described herein facilitate the automated picking of cut-out textile panels off the textile cutter. The textile panel picker includes a flexible transport tube, a transport tube transfer arm to position the flexible transport tube over the tabletop of the textile cutter, a textile hopper to collect the textile panels, and a pneumatic pump assembly to evacuate air from the textile hopper and through the flexible transport tube. The computing device identifies and tracks the textile panels on the tabletop by capturing images of them on the tabletop, for example, and directs the transport tube transfer arm to position the flexible transport tube over the textile panels. The computing device also directs the pneumatic pump assembly to generate suction to pull one or more of the textile panels through the flexible transport tube and into the textile hopper.

As the textile panels are pulled through the flexible transport tube and into the textile hopper, the computing device can also coordinate the movement of one or more totes along a conveyor line, for example, and open the textile hopper at the appropriate time to drop the textile panels into the totes. In turn, the totes can be routed along a system of conveyor belts to various assembly stations where the textile panels can be assembled into finished textile products.

Automated fabric picking using the textile panel picker described herein can be more reliable than other ways of picking textile panels. Additionally, the textile panel picker can pick textile panels with less chances of damaging them as compared to other mechanical picking structures. Overall, the concepts described herein facilitate the automated manufacturing of various types of textile products by providing an automated, reliable, and careful way to pick and collect various sizes, shapes, and types of textile panels for assembly into finished textile products.

Before turning to the figures, it is noted that the embodiments are not limited to the manufacture of any particular type(s) of textile, fabric, or clothing products from any particular type(s) of materials. Instead, the concepts described herein can be applied to the manufacture of a wide array of products, including clothing or fabric products, accessories (e.g., scarves, gloves, hats, bags, belts, etc.), footwear, bedding, curtains, towels, etc., in a wide variety of materials, including but not limited to paper, plastic, leather, rubber, and other materials. Thus, references to panels, sheets, textile panels, and textile sheets, among other terms, are not intended to be limiting as to the types of materials that can be printed upon, cut, and picked using the concepts described herein.

Turning to the figures, FIG. 1 illustrates a networked environment 100 for automated panel printing, cutting, and picking. The networked environment 100 includes a computing environment 110, a network 150, and one or more client devices 160. At facility 170, the networked environment 100 also includes a textile printer 172, a textile dryer 174, a textile cutter 176, a textile panel picker 177, and a textile production line 178.

The locations of the computing environment 110, the client devices 160, and the facility 170 are representative in FIG. 1, and the embodiments can be organized and/or distributed in other ways than that shown. For example, the computing environment 110 can be geographically located, in part or in its entirety, at the facility 170. Alternatively, the computing environment 110 can be geographically dislocated from the facility 170 while controlling and/or directing the operation of certain equipment in the facility 170 via the network 150, including one or more of the textile printer 172, a textile dryer 174, a textile cutter 176, a textile panel picker 177, and a textile production line 178. In either case, the network 150 can facilitate two-way data and control communications between the computing environment 110 and certain equipment in the facility 170.

The computing environment 110 includes an apparel manufacturing data store 120, a print engine 132, a cut engine 134, and an assembly engine 136. In the networked environment 100, the computing environment 110 is configured to direct certain textile printing, cutting, picking, and assembly processes at the facility 170 through communications with and control of one or more of the textile printer 172, textile dryer 174, textile cutter 176, textile panel picker 177, and textile production line 178 via the network 150.

The computing environment 110 is configured to collect orders for products, such as products that incorporate textile, paper, plastic, leather, rubber, and/or other materials, from the client device 160. The orders can be received over time via the network 150 in the form of (or along with) tech packs 180, for example. Once received, the orders can be stored in the apparel manufacturing data store 120 for further processing by the computing environment 110. The tech packs 180 can be embodied as various types of digital files, such as job definition format (JDF) or other types of files that define instructions to manufacture one or more textile products at the facility 170, for example, among other facilities. The tech packs 180 can specify one or more fabrics, one or more panels (e.g., pieces of fabric that can be sewn together into textile products, items of apparel, etc.), fabric colors, print patterns, or graphics, fabric weaves, naps, knits, or embroidery patterns, product assembly instructions, fastener locations and/or specifications, product quantities, price and/or cost limitations or requests, and other specifications of textile or other products to be manufactured.

Once received, the print engine 132 of the computing environment 110 is configured to aggregate or collect orders defined in one or more of the tech packs 180. After the orders are aggregated, the print engine 132 generates one or more textile panel templates 190 including various arrangements of panels 192 for the products in the orders. Any number of panels 192 can be defined in the textile panel templates 190 along with print patterns and other features related to the panels 192. The textile panel templates 190 comprise computer-readable files that define computer-readable instructions for the textile printer 172 to print certain panel outlines, print patterns, and other features on one or more textile sheets. Once the panels 192 are printed on a textile sheet, the cut engine 134 of the computing environment 110 can instruct the textile cutter 176 to cut the panels 192 out from the textile sheet.

After the panels 192 are cut out from the textile sheet using the textile cutter 176, the assembly engine 136 is configured to identify and track the cut-out panels 192 or pieces of fabric as they are moved along a tabletop of the textile cutter 176. The assembly engine 136 also directs the textile panel picker 177 to pick or pull those panels 192 off the tabletop of the textile cutter 176 using pneumatic evacuation or suction through a flexible transport tube as described herein. The assembly engine 136 tracks the panels 192 as they are picked, pulled, or moved off the tabletop of the textile cutter 176, through the flexible transport tube, and into a textile hopper of the textile panel picker 177. Thus, one or more panels 192 are collected into the textile hopper of the textile panel picker 177 before they are dropped into a container or tote 194 for transport to an assembly station 196 on the textile production line 178. Thus, the textile panel picker 177 is designed to pick the panels 192 off of the textile cutter 176 and place them into containers or totes 194 for assembly by sewing workers on the textile production line 178.

The assembly engine 136 can also generate assembly schemes with instructions for the assembly of the panels 192 into one or more textile products. The assembly schemes can be based, at least in part, on information provided in the tech packs 180. Once generated, the assembly schemes can be stored in the apparel manufacturing data store 120 for later reference. The generation of the assembly schemes, printing instructions related to those assembly schemes on textile sheets, and referencing those instructions are described in further detail in the '1640 application.

The textile printer 172 can be embodied as any suitable type of printer for printing on textile fabrics or other materials. Textile printing is related to textile dyeing but, rather than uniformly dyeing a fabric sheet in its entirety, textile printing involves applying one or more colors to only certain parts or areas of a textile sheet, often in sharply defined patterns. In that context, the textile printer 172 may be embodied, for example, as a digital textile printer, digital garment printer, or direct-to-garment printer. The textile printer 172 can use specialized inkjet technologies, for example, to apply ink directly on fabrics. The textile printer 172 can apply water-based, acid, reactive, or other types of inks depending upon the type of fabric or other material being printed upon. The textile printer 172 can print on fabrics that are woven, non-woven, knitted, netted, technical, etc., without limitation. The textile printer 172 can also print on other types of materials, such as paper, plastic, leather, rubber, and other materials. In some embodiments, the textile printer 172 can print on both sides of a textile sheet. As noted above, the textile printer 172 receives printing instructions from the print engine 132 over the network 150.

The textile dryer 174 can be embodied as any suitable type of dryer for drying ink printed on textile fabrics or other materials. The textile dryer 174 can include adjustable infrared or heat panels, for example, to dry or cure ink applied by the textile printer 172, as needed. In some embodiments, the textile dryer 174 may not be necessary based on the printing/ink technology used by the textile printer 172. Thus, the textile dryer 174 may be omitted and/or incorporated with the textile printer 172 in some embodiments. The operation of the textile dryer 174 can be controlled by the print engine 132 over the network 150, as needed.

The textile cutter 176 can be embodied as any suitable type of cutter, cutting table, or cutting machine having a cutting table or tabletop and a cutting assembly. For cutting and manipulating various types of fabrics and other materials, the cutting assembly of the textile cutter 176 can include one or more drag knives, wheel knives, lasers, pneumatic and/or electric oscillating cutting knives, lasers, and/or other tools, pneumatic and/or electric rotary cutting knives and/or tools, scoring tools, v-cutting (e.g., scissor-type) tools, partout tools, creasing tools, routing and/or engraving tools, water-cutting jets or related cutting tools, and other types of tools. The textile cutter 176 can include adjustable vacuums, rollers, clips, hold-downs, etc., to hold and/or maneuver textile sheets and other materials fed into the textile cutter 176. As noted above, the cut engine 134 is configured to generate cut control instructions for the textile cutter 176, and the cut control instructions can be communicated to the cut engine 134 as part of two-way control communications over the network 150.

In one embodiment, textile sheets can be fed directly from the textile printer 172 into the textile dryer 174 and, subsequently, the textile cutter 176. In other embodiments, the textile sheets can be manually moved and fed from the textile printer 172, to the textile dryer 174, and to the textile cutter 176.

As described in further detail below with reference to FIGS. 4 and 5, the textile panel picker 177 includes a flexible transport tube (or bundle of tubes), a transport tube transfer arm to position the flexible transport tube over the tabletop of the textile cutter 176, a textile hopper to collect the panels 192, and a pneumatic pump assembly to evacuate air from the textile hopper and through the flexible transport tube. The cut engine 134 and/or the assembly engine 136 are configured to identify and track the panels 192 on the tabletop of the textile cutter 176 by capturing images of them before, during, and/or after they are cut out using the textile cutter 176. The assembly engine 136 then directs the transport tube transfer arm to position the flexible transport tube over the panels 192. The assembly engine 136 also directs the pneumatic pump assembly to generate suction that pulls the panels 192 off the textile cutter 176, through the flexible transport tube, and into the textile hopper of the textile panel picker 177.

The textile production line 178 can be embodied as an arrangement of one or more conveyors, totes, sewing or assembly stations 196, and associated drive and control systems. Once the panels 192 are cut out from the textile sheets by the textile cutter 176, the panels 192 can be placed into one or more totes of the textile production line 178 for routing along its conveyor system to the sewing or assembly stations 196. Depending upon the type of orders being processed, the assembly engine 136 can generate instructions for placing the panels 192 into the totes. The assembly engine 136 is further configured to generate instructions for directing the totes along the conveyor system of the textile production line 178. Other aspects of the textile production line 178 are described in further detail in the '1640 application.

Figure 2:
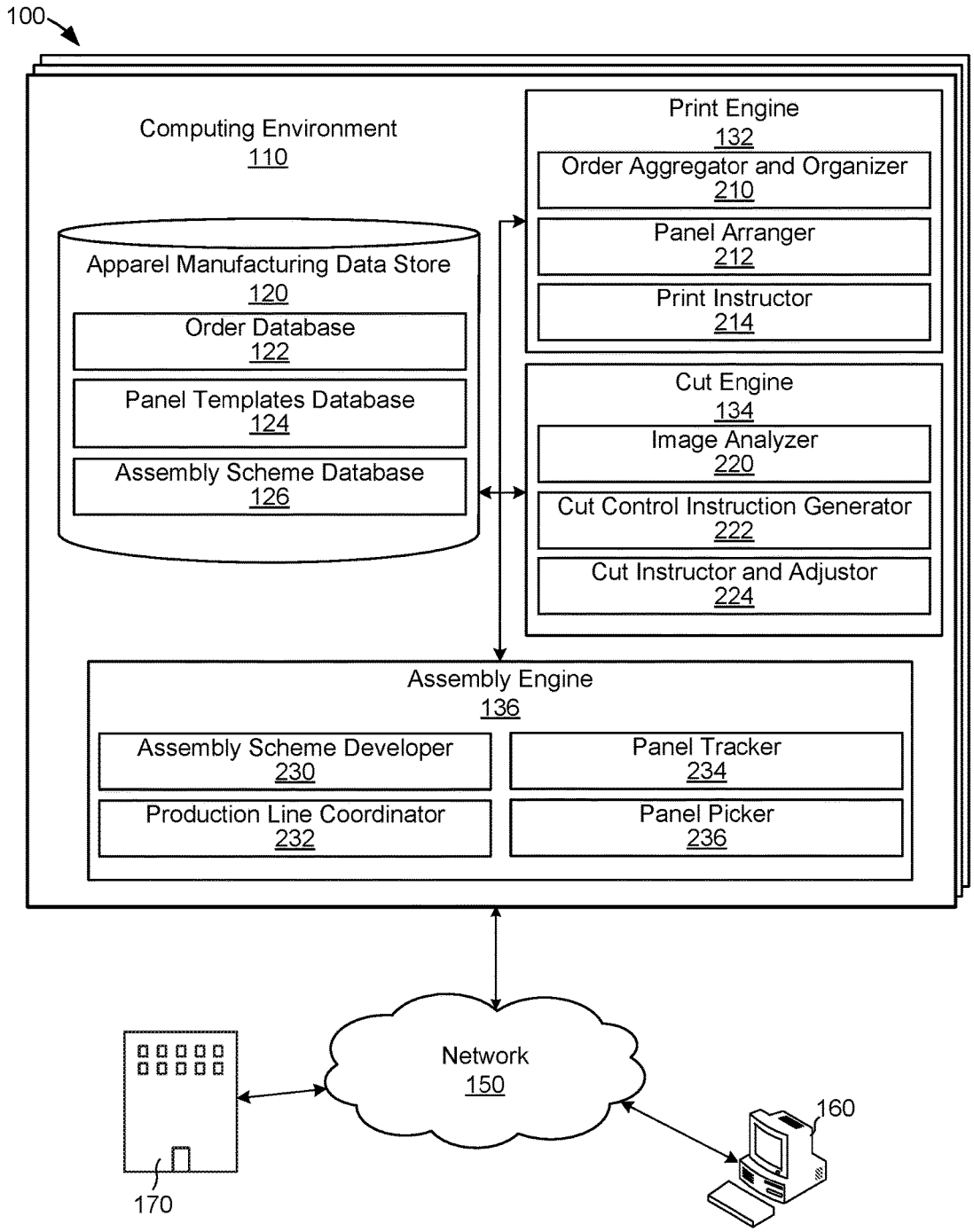
FIG. 2 illustrates a more detailed view of a computing environment shown in FIG. 1 according to various embodiments of the present disclosure.

FIG. 2 illustrates a more detailed view of the computing environment 110 shown in FIG. 1 according to various embodiments of the present disclosure. The computing environment 110 may be embodied as one or more computers, computing devices, or computing systems. In certain embodiments, the computing environment 110 may include one or more computing devices arranged, for example, in one or more server or computer banks. The computing device or devices may be located at a single installation site or distributed among different geographic locations. The computing environment 110 may include a plurality of computing devices that together embody a hosted computing resource, a grid computing resource, and/or other distributed computing arrangement. In some cases, the computing environment 110 may be embodied as an elastic computing resource where an allotted capacity of processing, network, storage, or other computing-related resources varies over time.

The computing environment 110 may also be embodied, in part, as various functional and/or logic (e.g., computer-readable instruction, device, circuit, processing circuit, etc.) elements configured to direct the computing environment 110 to perform aspects of the embodiments described herein. Additionally, to the extent that it interfaces over the network 150 with computing and/or control devices of the textile printer 172, textile dryer 174, textile cutter 176, textile panel picker 177, and textile production line 178 through service interfaces, application programming interfaces (APIs), etc., the computing environment 110 can be embodied as a collection of computing devices that includes the computing and/or control devices (or capabilities) of the textile printer 172, textile dryer 174, textile cutter 176, textile panel picker 177, and textile production line 178.

The network 150 may include the Internet, intranets, extranets, wide area networks (WANs), local area networks (LANs), wired networks, wireless networks, cable networks, satellite networks, local interfaces, other suitable networks or interfaces, or any combinations thereof. It is noted that the computing environment 110 may communicate with the computing and/or control devices of the textile printer 172, textile dryer 174, textile cutter 176, textile panel picker 177, and textile production line 178 using various systems interconnect models and/or protocols, such as simple object access protocol (SOAP), representational state transfer (REST), real-time transport protocol (RTP), user datagram protocol (UDP), internet protocol (IP), transmission control protocol (TCP), and/or other protocols for communicating data over the network 150, without limitation. The network 150 provides connections to various client devices and network hosts, such as the client devices 160, website servers, file servers, networked computing resources, databases, data stores, or any other network devices or computing systems.

The client devices 160 can be embodied as any type of computing device, processing circuit, or processor based device or system used by individuals, including those embodied in the form of a desktop computer, a laptop computer, a personal digital assistant, a cellular telephone, or a tablet computer, among others. The client devices 160 can include one or more peripheral and/or input devices, such as keyboards, keypads, touch pads, touch screens, microphones, cameras, etc.

As shown in FIG. 2, the apparel manufacturing data store 120 includes an order database 122, panel templates database 124, and an assembly scheme database 126. The print engine 132 includes an order aggregator and organizer 210, a panel arranger 212, and a print instructor 214. The cut engine 134 includes an image analyzer 220, a cut control instruction generator 222, and a cut instructor and adjustor 224. Further, the assembly engine 136 includes an assembly scheme developer 230, a production line coordinator 232, a panel tracker 234, and a panel picker 236.

The order database 122 includes a database of orders for textile products received from the client devices 160. In that context, the order database 122 can include a database of the tech packs 180, for example, along with any other specifications, quantities, price and/or cost limitations or requests, and other information associated with orders. The panel templates database 124 can include a database of the textile panel templates 190 generated by the print engine 132 as described herein. The assembly scheme database 126 can include a database of all the individual panels 192 in the textile panel templates 190, along with unique identifiers for those panels 192, assembly instructions associated with those panels, cut and/or pick control instructions associated with those panels 192, and other information. The apparel manufacturing data store 120 is not limited to storing the information described above, as other information and/or data can also be stored in the apparel manufacturing data store 120.

Turning to the components of the print engine 132, the order aggregator and organizer 210 is configured to aggregate and organize orders received from the client devices 160 based on one or more productivity or efficiency factors, such as size, shape, fabric type, delivery location, etc. For example, if a number of the orders specify fulfillment in the geographic location surrounding Seattle, Wash., the computing environment 110 may organize those orders into a group of orders for manufacture and/or fulfillment at a facility other than the facility 170. As another example, if a number of the orders specify textile products for manufacture using a type of fabric only available at the facility 170, the computing environment 110 may organize those orders into a group of orders for manufacture and/or fulfillment at the facility 170 rather than another facility. Generally, by aggregating orders from several client devices 160 and coordinating apparel manufacture and assembly processes on a relatively large scale, the networked environment 100 provides new ways to increase efficiency in apparel manufacturing.

The panel arranger 212 is configured to arrange the panels 192 for textile products into one or more textile panel templates 190 as noted above. The panels 192 can be representative of one or more sections or pieces of fabric or other materials from which shirts, pants, dresses, or other accessories or items can be assembled. In one embodiment, when arranging the panels 192, the panel arranger 212 is configured to closely align the panels 192 among each other to the extent possible to reduce scrap in textile sheets. Additionally or alternatively, the panel arranger 212 can orient the panels 192 in the textile panel templates 190 to align with a thread, weave, nap, knit, or print pattern(s) in textile sheets. The panel arranger 212 is also configured to assign a unique identifier to each panel 192 in the textile panel templates 190 and store those unique identifiers in the apparel manufacturing data store 120 for reference by the computing environment 110.

In one embodiment, the panel arranger 212 is configured to generate the textile panel templates 190 in a computer-readable computer-aided-manufacturing (CAM) or similar file format. In that case, the textile panel templates 190 can be provided, in relevant part(s), as instructions from the computing environment 110 to one or more of the textile printer 172, the textile dryer 174, the textile cutter 176, and the textile panel picker 177 over the network 150.

The print instructor 214 is configured to coordinate the printing operations of textile printers, such as the textile printer 172, over the network 150. For example, the print instructor 214 can generate print instructions based on one or more of the textile panel templates 190 and forward those instructions (or the textile panel templates 190 themselves) to the textile printer 172. Additionally, the print instructor 214 is configured to monitor the ongoing printing operations of the textile printer 172. In that context, the print instructor 214 can identify printing errors, printing delays, and other printing-related activities and factors at the textile printer 172 based on the two-way data and control communications between the computing environment 110 and the textile printer 172. In that way, the print instructor 214 can coordinate the printing operations with the cutting operations directed by the cut engine 134 and the picking and assembling operations directed by the assembly engine 136.

Turning to the components of the cut engine 134, the image analyzer 220 is configured to capture images of the panels 192 printed on a textile sheet (or sheet of another material) during cutting processes performed by the textile cutter 176. In that context, consistent with the description provided in the '874 application, the textile cutter 176 can include an arrangement of cameras to capture images of textile sheets being cut. Using the images of textile sheets, the image analyzer 220 is configured to identify factors to control the cut of the textile sheet. For example, a textile thread, weave, nap, or knit of the textile sheet, textile print pattern alignment on the textile sheet, or panel deformation of the textile sheet can be identified by the image analyzer 220. The image analyzer 220 can also identify various features printed on the textile sheets by the textile printer 172, such as the assembly notations, panel cutouts, cut alignment markers, and other features related to the panels 192. Additionally, the image analyzer 220 can assist the panel tracker 234 of the assembly engine 136 to identify and track the panels 192 on the textile cutter 176 as described herein.

Based on the analysis performed by the image analyzer 220, the cut control instruction generator 222 can generate cut control instructions to cut out the panels 192 from the textile sheets. The cut control instructions can be generated in the form of a CAM or similar file format for processing and/or interpretation by the textile cutter 176. In the generation of cut control instructions, the cut control instruction generator 222 can refer to various types of information. For example, the cut control instruction generator 222 can refer to the analysis performed by the image analyzer 220, the textile panel templates 190, the specifications of the textile sheets (e.g., the type, thickness, grade, weave pattern, thread count, etc.) being cut, and other information and factors.

After they are generated, the cut instructor and adjustor 224 can forward the cut control instructions to the textile cutter 176 over the network 150. The cut instructor and adjustor 224 is also configured to adapt the cut control instructions over time and during cutting operations based on the analysis performed by the image analyzer 220. By capturing images of textile sheets after panels and/or print patterns have been printed on them and adjusting the cut control instructions provided to the textile cutter 176 using feedback gathered from images, the cut instructor and adjustor 224 can dynamically adjust the cutting operations performed by the textile cutter 176.

Turning to the components of the assembly engine 136, the assembly scheme developer 230 is configured to generate assembly schemes for the assembly of textile products based on the instructions in the tech packs 180, for example, and to coordinate the operations of the textile panel picker 177 and the textile production line 178. The production line coordinator 232 is configured to direct one or more of the totes 194 on the textile production line 178 to the textile panel picker 177 to receive the panels 192 for assembly. Where the textile production line 178 is relied upon for the assembly of textile and/or other products, the production line coordinator 232 can generate instructions to direct the panels 192, once placed into the totes 194, to various assembly stations 196 on the textile production line 178.

The panel tracker 234 is configured to capture one or more images of the textile sheet on the textile cutter 176 before, after, and/or while the textile sheet is cut. Using those images, the panel tracker 234 can identify and track the panels 192 as they are fed over the cutting table or tabletop of the textile cutter 176 using image processing techniques. To some extent, the panel tracker 234 performs identification and tracking operations similar to those performed by the image analyzer 220 of the cut engine 134, and the panel tracker 234 can perform panel identification and tracking processes in connection with the image analyzer 220. That is, the image analyzer 220 can assist the panel tracker 234 of the assembly engine 136 to identify and track the panels 192 on the textile cutter 176 as described herein. In some embodiments, the image analyzer 220 can be combined with the panel tracker 234 as one functional element in the computing environment 110.

The panel picker 236 is configured to use the panel identification and tracking information provided by the panel tracker 234, among other information, to estimate a characteristic, such as the type, shape, weight and/or size of each of the panels 192. In addition to the image-based identification and tracking information, the panel tracker 234 can estimate the type, shape, weight, and/or size of each of the panels 192 based on information in the textile panel templates 190. For example, the textile panel templates 190 can define panel cutouts, cut alignment markers, and other features related to the size of the panels 192. Further, the apparel manufacturing data store 120 can store the specifications of the textile sheets being cut, such as the type, thickness, grade, and other information related to the textile sheets. Thus, based on the size and/or shape of the panel cutout for a panel 192 and the grade of the textile sheet being cut, among other information, the panel picker 236 can also estimate a weight of each of the panels 192.

The panel picker 236 can refer to the characteristic information for a panel 192 to determine a leading pickup region for automated panel picking. As described in further detail below, the leading pickup region is the region of the panel 192 that is first pulled or picked off the tabletop of the textile cutter 176 by the textile panel picker 177. Leading and trailing pickup regions are described in further detail below with reference to FIG. 6B.

In certain embodiments, the textile panel picker 177 can include a group of two, three, or more flexible transport tubes for the transport of the panels 192. As described in further detail below with reference to FIG. 6A, the group of flexible transport tubes can include tubes of different diameters. In that case, the panel picker 236 can also refer to the weight and/or size information of a panel 192 to select one of the flexible transport tubes to pick the panel 192 off the tabletop. For example, a tube of smaller diameter can be used for smaller and/or lighter panels 192, and a tube of larger diameter can be used for larger and/or heavier panels 192.

In addition to determining a leading pickup region and selecting a flexible transport tube, the panel picker 236 can also calculate a level of evacuation to pull the panel 192 through the selected flexible transport tube and into the textile hopper of the textile panel picker 177. The level of evacuation can be selected based on the weight and/or the size of the panel 192, the diameter of the flexible transport tube selected to transport the panel 192, and other considerations and factors.

The panel picker 236 is further configured to direct a pneumatic pump assembly of the textile panel picker 177 to generate an amount of suction to pull the panel 192 through the selected flexible transport tube. In other words, after the selected flexible transport tube is positioned over the leading pickup region of the panel 192, the panel picker 236 directs the pneumatic pump assembly of the textile panel picker 177 to pull the panel 192 through the selected flexible transport tube using the evacuation or suction of air through the tube. At the same time, the panel picker 236 can track the panel 192 as it is pulled off the tabletop of the textile cutter 176, through the selected flexible transport tube, and into the textile hopper of the textile panel picker 177. The panel picker 236 can track the panel 192 using cameras or other sensors.

While one or more panels 192 are being picked and pulled into the textile hopper of the textile panel picker 177, the production line coordinator 232 can direct one or more totes 194 on the textile production line 178 to the textile panel picker 177 to receive one or more of the panels 192. As described in further detail below with reference to FIG. 5, the textile hopper of the textile panel picker 177 includes doors that can be opened by the production line coordinator 232. When opened, one or more panels 192 in the textile hopper can drop into a tote 194.

Figure 3:
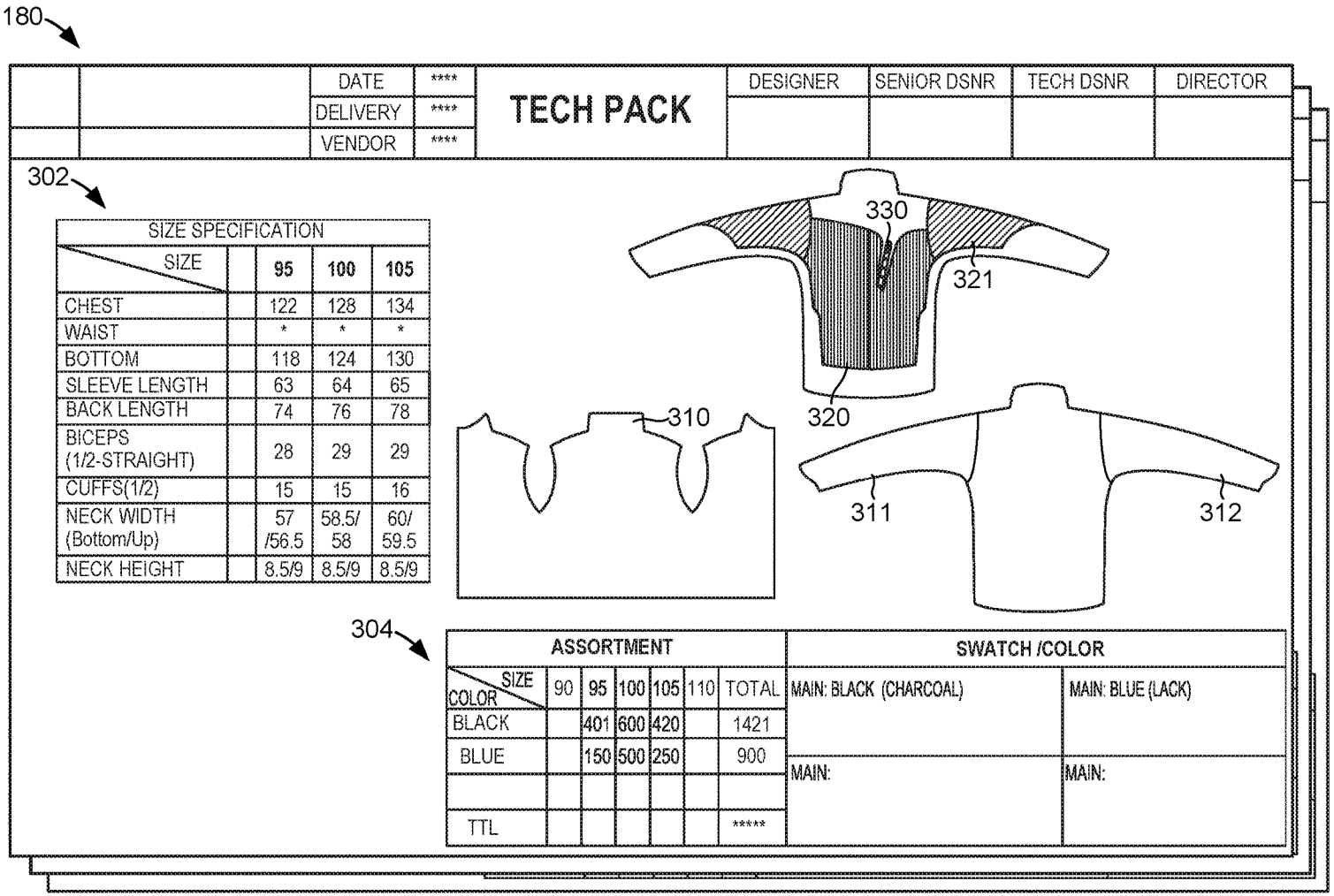
FIG. 3 illustrates an example tech pack according to various embodiments of the present disclosure.

FIG. 3 illustrates an example tech pack 180 for apparel manufacturing according to various embodiments of the present disclosure. FIG. 3 is provided by way of example of the types of information that can be included or defined in a tech pack 180, but is not intended to be limiting, as the requirements for different textile and other products vary. Further, the tech pack 180 is not necessarily representative of the format or of the types of information included or defined in all orders for products received from the client devices 160. In various embodiments, the tech packs 180 can be embodied as digital or electronic files, such as JDF or other types of files.

As shown in FIG. 3, the tech pack 180 includes the specifications of a textile product, including size specifications 302, order piece/assortment specifications 304, panel size and shape specifications 310-312, fabric type/print pattern specifications 320 and 321, and fastener specifications 330. Although not shown in FIG. 3, the tech pack 180 can also include or define assembly specifications, such as seams, hems, stitch patterns, thread types and/or colors, a suggested order of assembly tasks or operations, etc. As discussed above, the tech pack 180 can be generated at any of the client devices 160 and forwarded to the computing environment 110 over the network 150.

Figure 4:
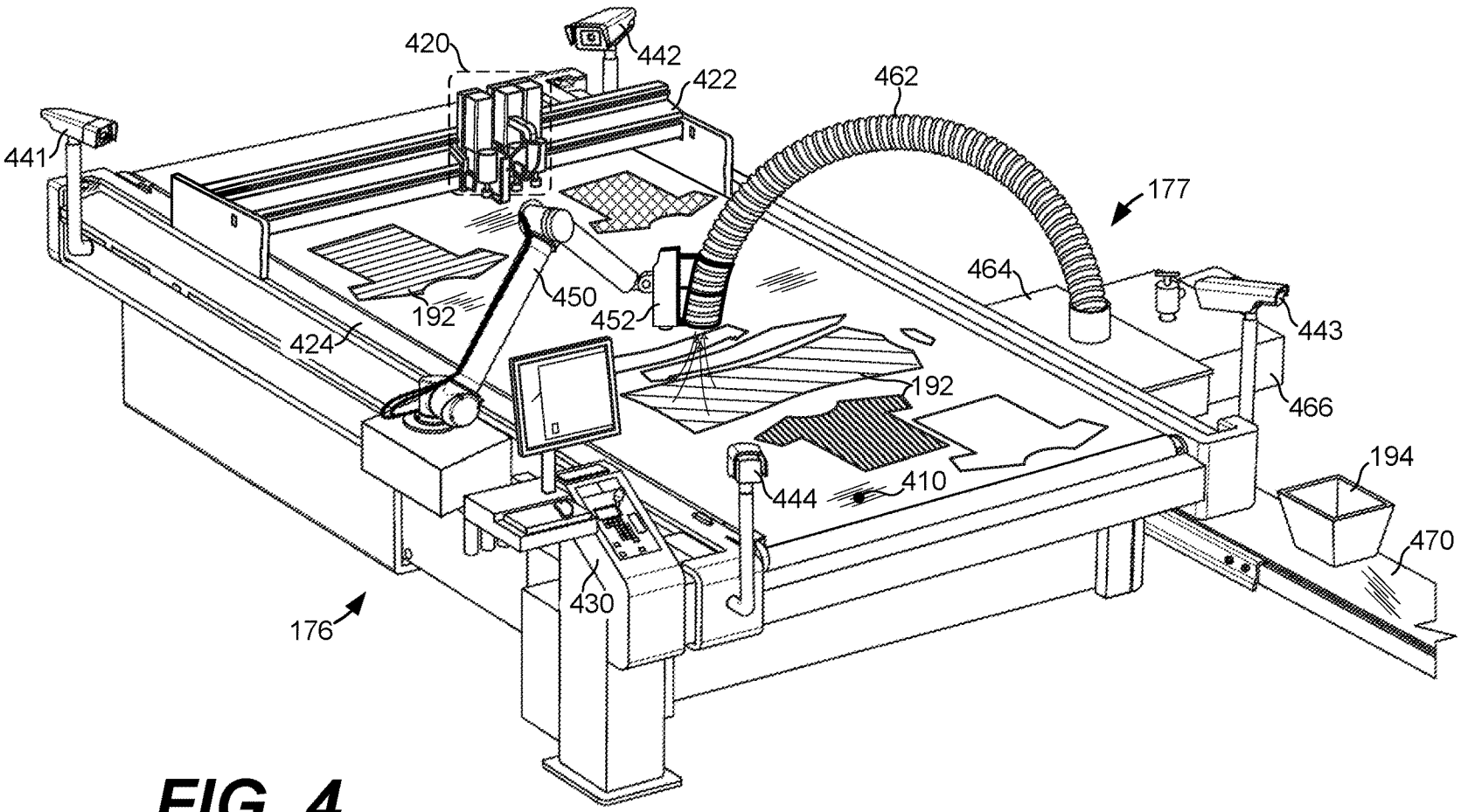
FIG. 4 illustrates an example textile cutter and textile panel picker according to various embodiments of the present disclosure.

FIG. 4 illustrates an example of the textile cutter 176 and the textile panel picker 177 according to various embodiments of the present disclosure. In FIG. 4, the textile printer 172, among other equipment shown in FIG. 1 at the facility 170, is omitted for simplicity. Although it is omitted from view in FIG. 4, the textile printer 172 prints various panels 192 on the textile sheet 410 based on print control instructions received from the print engine 132. In turn, the textile sheet 410 is fed (e.g., pulled) over a tabletop 424 of the textile cutter 176. The textile cutter 176 can include adjustable vacuums, rollers, clips, hold-downs, etc., to hold and/or maneuver the textile sheet 410 as it is being fed over the textile cutter 176 for cutting.

In one embodiment, the textile cutter 176 includes a cutting head assembly 420 adjustably mounted to an articulating rail 422. The articulating rail 422 is adjustably mounted to the tabletop 424 of the textile cutter 176. Using motors, pulleys, or another suitable mechanism, the cutting head assembly 420 can move or slide along the articulating rail 422, and the articulating rail 422 can move or slide along the length of the tabletop 424. Thus, the cutting head assembly 420 is configured to traverse the tabletop 424 to cut the panels 192 out from the textile sheet 410.

The cutting head assembly 420 includes one or more tools for cutting the panels 192 out of the textile sheet 410. For example, the tools can include one or more drag knives, wheel knives, lasers, pneumatic and/or electric oscillating cutting knives and/or tools, pneumatic and/or electric rotary cutting knives and/or tools, scoring tools, v-cutting (e.g., scissor-type) tools, partout tools, creasing tools, routing and/or engraving tools, and other types of tools for cutting and/or manipulating the textile sheet 410. In other examples, the textile cutter 176 can be embodied as a laser cutting continuous feed system as described in the '1630 application.

The textile cutter 176 also includes cameras 441-444 placed around the tabletop 424 and, in some embodiments, another camera positioned in the cutting head assembly 420. The camera in the cutting head assembly 420 provides a close view of the cutting operations performed by the cutting head assembly 420. The cameras 441-444 can include any suitable type of image sensor for capturing the details of the textile sheet 410. In one embodiment, the cameras 441-444 can include high-resolution image sensors capable of capturing thread or weave patterns in the textile sheet 410, as well as fine details printed on the textile sheet 410 by the textile printer 172. In one embodiment, the cameras 441-444 can include an image sensor capable of capturing the reflection of long wave ultraviolet ("UV") light. In that case, the cameras 441-444 may also include UV light bulbs or emitters that cast UV light upon the textile sheet 410. In that way, UV light reflected by washable, UV-reflective inks printed upon the textile sheet 410 by the textile printer 172 can be captured in images by the cameras 441-444.

Using images captured by the cameras 441-444, the image analyzer 220 is configured to identify factors to control the cut of the textile sheet 410 by the textile cutter 176. For example, a textile thread, weave, nap, or knit pattern of the textile sheet 410, textile print pattern alignment on the textile sheet 410, or panel deformation of the textile sheet 410, can be identified by the image analyzer 220. The image analyzer 220 can also identify certain features printed on the textile sheets by the textile printer 172, such as assembly notations, panel cutouts, cut alignment markers, and other features.

The textile cutter 176 also includes a cutter controller 430 that directs the operation of the textile cutter 176. The cutter controller 430 can be embodied as any suitable combination of analog, digital, or analog and digital processing circuitry, including memory, configured to control the operation of the textile cutter 176. Thus, the cutter controller 430 can be embodied as a collection of vendor-specific logic, software, and/or hardware that directs the textile cutter 176 to perform various cutting operations. The cutter controller 430 also includes the physical and logical interfaces for two-way control communications with the computing environment 110 over the network 150, such as physical layer network interfaces, service interfaces, APIs, etc.

As shown in FIG. 4, the textile panel picker 177 includes a flexible transport tube 462, a transport tube transfer arm 450 to position the flexible transport tube 462 over the tabletop 424 of the textile cutter 176, a textile hopper 464 to collect the panels 192, and a pneumatic pump assembly 466 to evacuate air from the textile hopper 464 and through the flexible transport tube 462. In the illustrated embodiment, an open end of the flexible transport tube 462 is mechanically fixed or connected to the camera head 452 of the transport tube transfer arm 450. The other end of the flexible transport tube 462 connects into the textile hopper 464.

The transport tube transfer arm 450 can be embodied as a robotic arm or other mechanism capable of repositioning the open end of the flexible transport tube 462 over the tabletop 424. The camera head 452 includes a camera similar to the cameras 441-444. Images captures by the camera head 452 can be relied upon by the panel tracker 234 to track and confirm the position of the open end of the flexible transport tube 462 over one or more of the panels 192. Based on control instructions from the panel picker 236, the transport tube transfer arm 450 can position the camera head 452 and the open end of the flexible transport tube 462 over a leading pickup region, for example, of one of the panels 192. Once the flexible transport tube 462 is correctly positioned, the panel picker 236 can direct the pneumatic pump assembly 466 to evacuate air from the textile hopper 464 and, in turn, through the flexible transport tube 462. In that way, the pneumatic pump assembly 466 generates suction to pull the panel 192 through the flexible transport tube 462 and into the textile hopper 464.

As shown in FIG. 4, once one or more panels 192 have been collected into the textile hopper 464, the panels 192 can be dropped into the tote 194. As noted above, the production line coordinator 232 can direct the conveyor belt 470 to position the tote 194, among other totes on the textile production line 178, below the textile hopper 464, and the panel picker 236 can direct the textile hopper 464 to open a door or gate, for example, to drop the panels 192 into the tote 194.

Any number of panels 192 can be pneumatically pulled into the textile hopper 464 and dropped, together, into the tote 194. For example, the panel picker 236 can direct the textile panel picker 177 to pick all the panels 192 for a particular article of clothing, pull them all into the textile hopper 464, and drop them all into the tote 194. Alternatively, the panel picker 236 can direct the textile panel picker 177 to pick less than all the panels 192 for a particular article of clothing, pull them into the textile hopper 464, and drop them into the tote 194. In that context, the panel picker 236 can work in connection with the production line coordinator 232 to generate instructions for picking any combination of the panels 192 off the tabletop 424 of the textile cutter 176 and transferring them into the tote 194.

Figure 5:
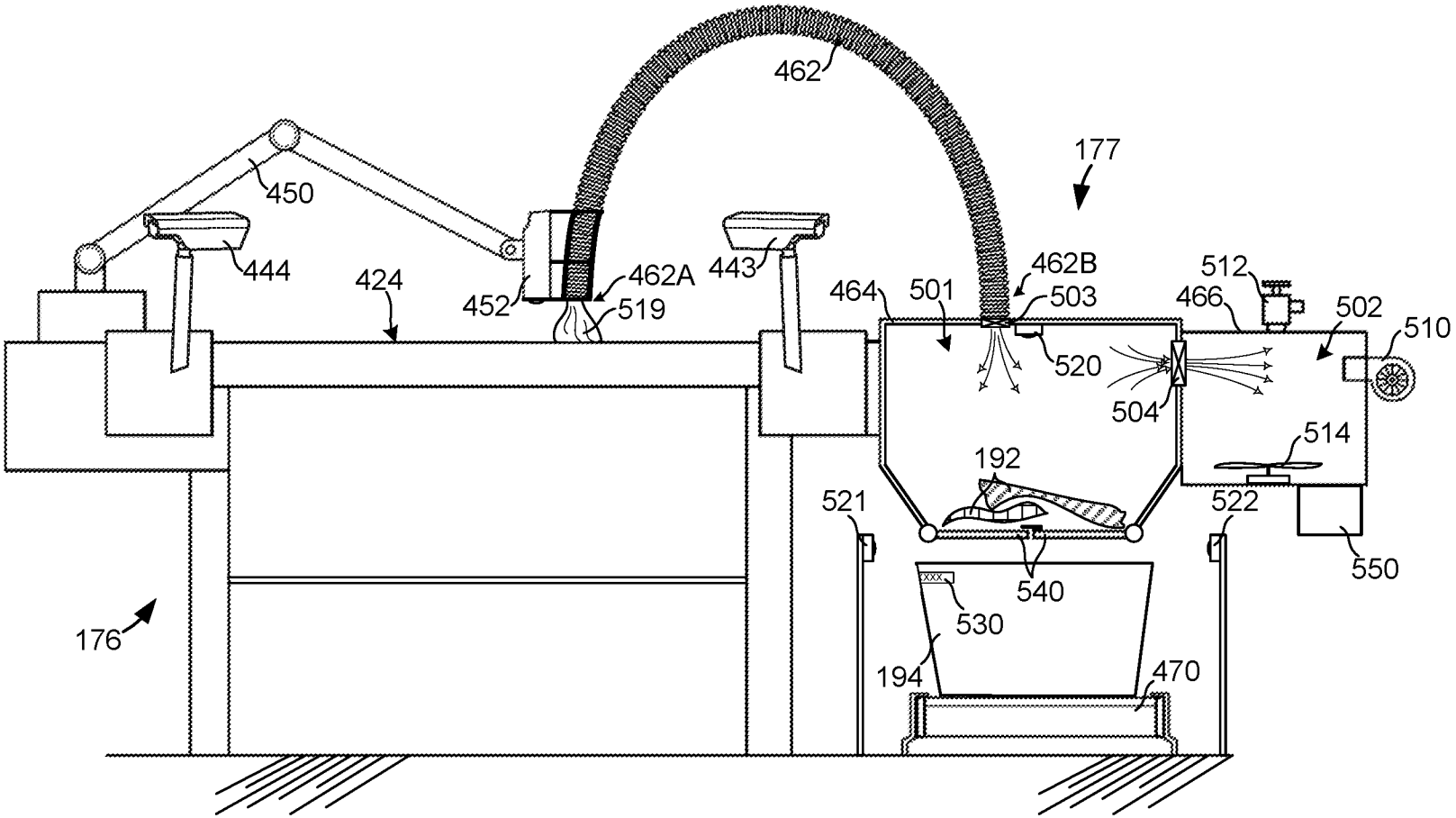
FIG. 5 illustrates another view of the textile cutter and textile panel picker shown in FIG. 4 according to various embodiments of the present disclosure.

FIG. 5 illustrates another view of the textile cutter 176 and textile panel picker 177 shown in FIG. 4 according to various embodiments of the present disclosure. The arrangement shown in FIG. 5 is provided as a representative example of one way the textile panel picker 177 can be designed. Within the scope of the embodiments, the shape, size, and arrangement of the textile hopper 464 and the pneumatic pump assembly 466 can vary as compared to that shown. Further, one or more of the valves, sensors, pumps, etc. of the textile panel picker 177 shown in FIG. 5 and discussed below can be repositioned and/or omitted. In other cases, additional valves, sensors, pumps, etc. can be incorporated into the textile panel picker 177. Further, although only one textile panel picker 177 is shown in FIGS. 4 and 5, additional ones can be arranged around the textile cutter 176 to increase the speed at which panels 192 can be picked and pulled off the tabletop 424. Similarly, the transport tube transfer arm 450 can be placed or arranged along any side of the textile cutter 176, including along the same side as the textile hopper 464 and pneumatic pump assembly 466.

In FIG. 5, the open end 462A of the flexible transport tube 462 is shown connected or affixed to the camera head 452 of the transport tube transfer arm 450, and the other end 462B of the flexible transport tube 462 connects to and opens into the textile hopper 464. The flexible transport tube 462 can be embodied as any suitable type of hollow, flexible tube within which a piece of fabric or other material can be pulled through using pneumatic suction. Preferably, the flexible transport tube 462 is flexible enough to be easily repositioned by the transport tube transfer arm 450 and long enough to reach across a significant portion of the tabletop 424 of the textile cutter 176. In some embodiments, the flexible transport tube 462 can be embodied as a bundle of flexible transport tubes of various diameters. An example flexible transport tube bundle is described in further detail below with reference to FIG. 6A.

The textile hopper 464 is shown having a hopper chamber 501, and the pneumatic pump assembly 466 is shown having a pump chamber 502. Although the hopper chamber 501 and the pump chamber 502 are shown in FIG. 5, it should be appreciated that both the textile hopper 464 and the pneumatic pump assembly 466 are fully enclosed and designed to be as air-tight as possible. Both the textile hopper 464 and the pneumatic pump assembly 466 can be formed from any suitable type of material, such as wood, metal, or plastic boards or sheets, for example, to enclose a certain volume of space. The sizes of the hopper chamber 501 and the pump chamber 502 can vary among the embodiments depending upon the type and/or number of panels 192 being pulled or picked off the tabletop 424 of the textile cutter 176. In that way, the hopper chamber 501 and the pump chamber 502 can maintain a vacuum or negative air pressure as compared to the space outside the textile hopper 464 and the pneumatic pump assembly 466.

In one embodiment, a first valve 503 is provided between the end 462B of the flexible transport tube 462 and the hopper chamber 501, and a second valve 504 is provided between the hopper chamber 501 and the pump chamber 502. In other embodiments, one or both of the valves 503 and 504 can be omitted. As described in further detail below, the valves 503 and 504 can be electronically opened and closed to permit or prevent suction through the flexible transport tube 462 and within the hopper chamber 501.

The pneumatic pump assembly 466 includes a pneumatic pump 510, a pressure relief valve 512, and an air mixer 514. In one embodiment, the pneumatic pump 510 includes a blower motor, such as a brushless motor, including an air rotor or turbine to pull or evacuate air out from the pump chamber 502. In that way, the pneumatic pump 510 can create a vacuum within the pump chamber 502. When the valve 504 is open, the pneumatic pump 510 can create a vacuum within both the pump chamber 502 and the hopper chamber 501. When both the valves 503 and 504 are open, the pneumatic pump 510 can create a vacuum within the pump chamber 502 and the hopper chamber 501 and pull air through the flexible transport tube 462. When air is pulled through the flexible transport tube 462, an evacuative draw 519 of air is created at the open end 462A of the flexible transport tube 462. The evacuative draw 519 is used by the textile panel picker 177 to pick or pull cut-out panels 192 off the tabletop 424 of the textile cutter 176 and into the hopper chamber 501. In FIG. 5, two panels 192 are shown within the hopper chamber 501.

As described herein, the panel picker 236 can calculate a level of the evacuative draw 519 required to pick and pull a panel 192 through the flexible transport tube 462 and into the textile hopper 464. The level of the evacuative draw 519 can be calculated based on the weight and/or the size of the panel 192 being picked, the diameter of the flexible transport tube 462, and other considerations and factors. In turn, the panel picker 236 of the computing environment 110 can direct the speed or power level of the pneumatic pump 510 over the network 150 based on the level of the evacuative draw 519 necessary to pick and pull any given panel 192 through the flexible transport tube 462. Additionally or alternatively, the panel picker 236 can control one or more of the valves 503 and 504 to adjust the level of the evacuative draw 519 at the open end 462A of the flexible transport tube 462. Thus, it should be appreciated that the evacuative draw 519 can be controlled (e.g., started, stopped, increased, decreased, etc.) through a combination of controls, including control of the pneumatic pump 510 and the valves 503 and 504 by the panel picker 236.

The pressure relief valve 512 can be manually or electrically adjusted to allow air to enter into the pump chamber 502 when a difference in pressure between the area outside the pump chamber 502 and that within pump chamber 502 exceeds a certain level. In that way, the pressure relief valve 512 can help to prevent the pneumatic pump 510 from burning out in the event that one or both of the valves 503 and 504 malfunction or a panel 192 becomes stuck within the flexible transport tube 462 or the valves 503, 504. The air mixer 514 can be embodied as a motor and air rotor to mix the contents of the pump chamber 502. The contents of the pump chamber 502 can be mixed over time using the air mixer 514 to prevent (or mitigate) any buildup of textile fibers or other materials. In various embodiments, one or more of the valves 503 and 504, the pressure relief valve 512, and/or the air mixer 514 can be omitted.

As shown in FIG. 5, the textile panel picker 177 includes various sensors, including the sensor 520 within the hopper chamber 501, and the sensors 521 and 522 between the textile hopper 464 and the tote 194. The sensor 520 can be used to monitor and/or confirm whether one or more panels 192 have been collected into the hopper chamber 501, and the sensors 521 and 522 can be used to monitor and/or confirm whether one or more panels 192 have been dropped or placed into the tote 194. Additional sensors can be placed at other locations within or around the textile panel picker 177, as necessary. The sensors 520-522 can be embodied as any sensor capable of detecting the presence of the panels 192, such as image or camera sensors, radar sensors, photosensors, or other types of sensors. One or both of the sensors 521 and 522 or additional sensors can also be relied upon to confirm the presence and/or position of the tote 194 below the textile hopper 464 on the conveyor belt 470. For example, the tote 194 can include a unique identifier tag 530, which can be embodied as a radio-frequency identification (RFID) tag, bar code, or other unique identifier of the tote 194, and the sensors 521 and 522 can scan the unique identifier tag 530 to confirm the presence of the tote 194 below the textile hopper 464.

As shown in FIG. 5, doors or gates 540 are provided at the bottom of the textile hopper 464. At the direction of the panel picker 236 and/or the production line coordinator 232, the gates 540 can be opened using any suitable mechanism to drop the panels 192 out from the textile hopper 464 and into the tote 194. The doors or gates 540 can be formed in various sizes and shapes among embodiments, and may be designed to maintain a vacuum within the hopper chamber 501 when closed.

The textile panel picker 177 also includes a panel picker controller 550 that directs the operation of the components of the textile panel picker 177. For example, the panel picker controller 550 can control the operation of the transport tube transfer arm 450, the pneumatic pump 510, the air mixer 514, the valves 503, 504, and 512, and the doors or gates 540 based on instructions provided by the computing environment 110 over the network 150. The panel picker controller 550 can be embodied as any suitable combination of analog, digital, or analog and digital processing circuitry, including memory, configured to control the operation of the textile panel picker 177. Thus, the panel picker controller 550 can be embodied as a collection of vendor-specific logic, software, and/or hardware that directs the textile panel picker 177 to perform various automated picking operations described herein. The panel picker controller 550 also includes the physical and logical interfaces for two-way control communications with the computing environment 110 over the network 150, such as physical layer network interfaces, service interfaces, APIs, etc. In other embodiments, the panel picker controller 550 may itself be configured to perform the functions described herein as being performed by the panel picker 236.

Figure 6A:
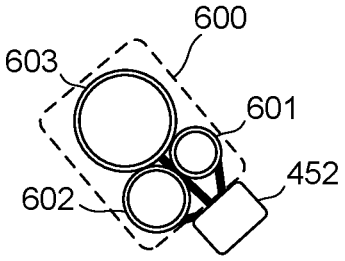
FIG. 6A illustrates an example cross-section of a flexible transport tube bundle according to various embodiments of the present disclosure.

FIG. 6A illustrates an example cross-section of a flexible transport tube bundle 600 according to various embodiments of the present disclosure. The flexible transport tube bundle 600 includes three flexible transport tubes similar to the flexible transport tube 462, with each having a different diameter. Particularly, the flexible transport tube bundle 600 includes a first flexible transport tube 601 having a first diameter, a second flexible transport tube 602 having a second diameter larger than the first flexible transport tube 601, and a third flexible transport tube 603 having a third diameter larger than the second flexible transport tube 602. Although three flexible transport tubes are shown in the flexible transport tube bundle 600, a bundle can include a greater or lesser number of tubes. Additionally, the tubes in a bundle can be arranged together in various configurations, such as in-line with each other or more closely grouped together as shown in FIG. 6A.

As shown in FIG. 6A, the flexible transport tube bundle 600 can be secured to the camera head 452 of the transport tube transfer arm 450. Each flexible transport tube of the bundle 600 can extend from the camera head 452 of the transport tube transfer arm 450 to the textile hopper 464, similar to the way the flexible transport tube 462 is shown in FIGS. 4 and 5. At the textile hopper 464, one or more valves similar to the valve 503 can be used to open or close individual ones of the flexible transport tubes 601-603.

The panel picker 236 can rely upon weight, textile type and/or size information associated with a panel 192 to select one of the flexible transport tubes 601-603 to pick the panel 192 off the tabletop 424 of the textile cutter 176. For example, the flexible transport tube 601 can be used for smaller and/or lighter panels 192, and the flexible transport tubes 603 can be used for larger and/or heavier panels 192.

Figure 6B:
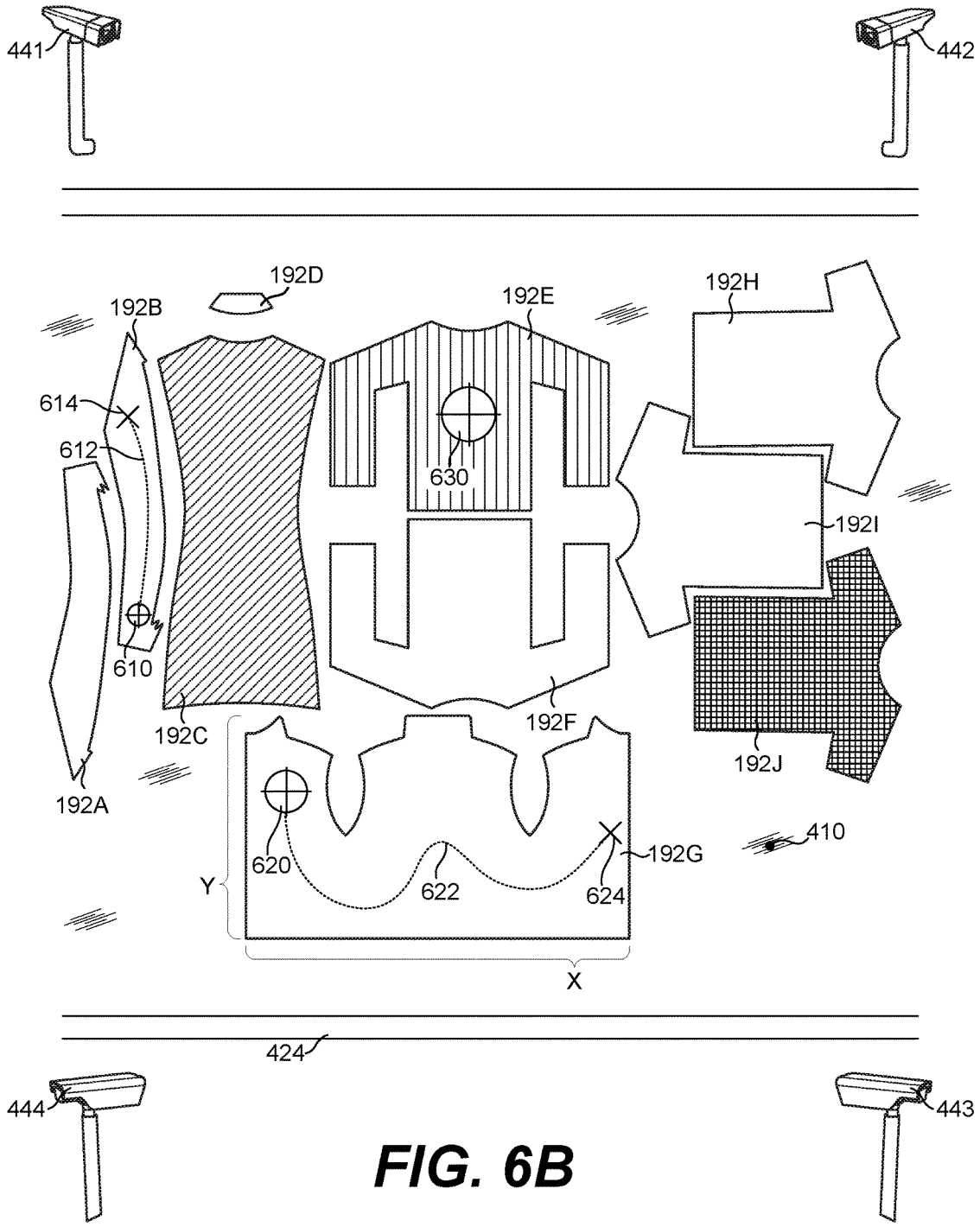
FIG. 6B illustrates an example identification of leading pickup regions, pickup paths, and trailing pickup regions for textile panels according to various embodiments of the present disclosure.

FIG. 6B illustrates an example identification of leading pickup regions, pickup paths, and trailing pickup regions for panels according to various embodiments of the present disclosure. In FIG. 6B, panels 192A-192J are shown printed on the textile sheet 410. Additionally, a representative example of the cameras 441-444 of the textile cutter 176 are also shown. As noted above, the panel tracker 234 is configured to capture one or more images of the textile sheet 410. Using those images, the panel tracker 234 can identify and track the panels 192A-192J as they are fed over the tabletop 424 of the textile cutter 176.

The panel picker 236 is configured to use the identification and tracking information provided by the panel tracker 234, among other information, to estimate a weight and/or a size of each of the panels 192A-192J. The panel picker 236 can estimate the size of each of the panels 192A-192J using image processing techniques to identify the outer boundaries or extents of the panels 192A-192J, such as the "X" and "Y" dimensions of the panel 192G shown in FIG. 6B. In some cases, the panel picker 236 can compare the dimensions of the panels 192A-192J identified from the images captured by the cameras 441-444 with the information defined in the textile panel templates 190 used to print the panels 192A-192J. Because the textile panel templates 190 can define panel cutouts, cut alignment markers, and other features related to the size of the panels 192A-192J, the panel picker 236 can refer to that information to identify and/or confirm the sizes of the panels 192A-192J. Further, the apparel manufacturing data store 120 can store the specifications of the textile sheet 410, such as the type, thickness, grade, and other information related to the textile sheet 410. Thus, based on the size of the panels 192A-192J and the grade of the textile sheet 410, among other information, the panel picker 236 can also estimate a weight of each of the panels 192A-192J.

Among other panel characteristic information, the panel picker 236 can refer to the weight and/or size information of the panels 192A-192J to determine an automated pickup approach for each of the panels 192A-192J. Each automated pickup approach can include the selection of a flexible transport tube, such as one of the flexible transport tubes 601-603 shown in FIG. 6A (if multiple tubes are available), the calculation of a level of evacuation necessary to pull one of the panels 192A-192J through the selected flexible transport tube, and the definition of leading and trailing pickup regions for the evacuation of the panel. At the same time, the panel picker 236 can determine a suitable sequence of opening and/or closing the valves in the textile panel picker 177, such as the valves 503 and 504 among others, depending upon which flexible transport tube is selected, for example.

For example, because the panel 192B is relatively slender, the panel picker 236 can select the flexible transport tube 601 because it has a more narrow diameter than the flexible transport tubes 602 or 603 shown in FIG. 6A. Additionally, because the panel 192B is relatively long, the panel picker 236 can identify a leading pickup region 610 at one end of the panel 192B, a pickup path 612 that runs along a predetermined length of the panel 192B, and a trailing pickup region 614 at another end of the panel 192B. The leading pickup region 610, pickup path 612, and trailing pickup region 614 define a tube transfer path over which the transport tube transfer arm 450 can move the selected flexible transport tube 601. As described above, the panel picker 236 can also calculate a level of evacuation to pull the panel 1926 through the flexible transport tube 601.

Once the panel picker 236 has defined the automated pickup approach for the panel 192B, it directs the textile panel picker 177 to pick the panel 192B off the tabletop 424 of the textile cutter 176 based on the approach. First, the panel picker 236 directs the transport tube transfer arm 450 to position the selected flexible transport tube 601 over the leading pickup region 610 of the panel 192B. Once the flexible transport tube 601 has been so positioned, the panel picker 236 can direct the pneumatic pump 510 to create the evacuative draw 519 at the calculated level of evacuation to pull the end of the panel 192B off the tabletop 424 based on its weight and/or size. Then, the panel picker 236 can further direct the transport tube transfer arm 450 to sweep or move the flexible transport tube 601 at a controlled rate of speed over the pickup path 612 to the trailing pickup region 614. At the trailing pickup region 614, the pneumatic pump 510 can be turned off. The pneumatic pump 510 can be turned off (or the valve 503 closed) once the panel 192B has been identified in the hopper chamber 501 using the sensor 520, for example.

As another example, because the panel 192G is larger than the panel 192B, the panel picker 236 can select the flexible transport tube 602 shown in FIG. 6A because it has a larger diameter than the flexible transport tube 601. The panel picker 236 can also identify a leading pickup region 620 at one side of the panel 192G, a pickup path 622 that runs in a curved path across a central region of the panel 192G, and trailing pickup region 624 at another side of the panel 192G. The leading pickup region 620, pickup path 622, and trailing pickup region 624 define a tube transfer path over which the transport tube transfer arm 450 can move the flexible transport tube 602 to pick up the panel 192G. The panel picker 236 can also calculate a level of evacuation to pull the panel 192G through the flexible transport tube 602. As compared to the level of evacuation to pull the panel 192B, the level of evacuation to pull the panel 192G may be higher because the panel 192G is larger and the diameter of the flexible transport tube 602 is greater than the flexible transport tube 601.

Once the panel picker 236 has defined the automated pickup approach for the panel 192G, it directs the textile panel picker 177 to pick the panel 192G off the tabletop 424 of the textile cutter 176 based on the approach. First, the panel picker 236 directs the transport tube transfer arm 450 to position the flexible transport tube 602 over the leading pickup region 620 of the panel 192G. Once the flexible transport tube 602 has been positioned over the leading pickup region 620, the panel picker 236 can direct the pneumatic pump 510 to create the evacuative draw 519 at the calculated level of evacuation to pull the end of the panel 192G off the tabletop 424. Then, the panel picker 236 can further direct the transport tube transfer arm 450 to sweep the flexible transport tube 602 over the pickup path 622 to the trailing pickup region 624 where the pneumatic pump 510 can be turned off or the valve 503 can be closed.

As another example, the panel picker 236 can select the flexible transport tube 603 shown in FIG. 6A to pick up the panel 192E. The panel picker 236 can also identify a single pickup area 630 for the panel 192E. The panel picker 236 can also calculate a level of evacuation to pull the panel 192E through the flexible transport tube 603 based on its weight and/or size, for example. For the panel 192E, the panel picker 236 does not calculate a pickup path, and it is not necessary for the transport tube transfer arm 450 to sweep the flexible transport tube 603 over the panel 192E. If possible, the panel picker 236 may attempt to pick panels up off the tabletop 424 using evacuation at a single location to save time, etc.

During an automated pickup approach for any of the panels 192A-192J, the panel picker 236 can control and/or monitor the components of the textile panel picker 177. For example, the panel picker 236 can control the values 503 and 504 and monitor feedback information provided by the sensors 520-522, the cameras 441-444, and the camera head 452. The valves 503 and 504 can be opened and/or closed to control or adjust the level of evacuation generated by the pneumatic pump 510 (e.g., in addition to directly controlling the speed of the pneumatic pump 510), the cameras 441-444 and/or the camera head 452 can be monitored to confirm that the panels 192A-192J have been picked up off the tabletop 424 of the textile cutter 176, and the sensor 520 can be monitored to confirm whether the panels 192A-192J have been pulled into the hopper chamber 501.

The panel picker 236 can also signal an error under certain circumstances, such as if one of the panels 192A-192J is picked up off the tabletop 424 but is not pulled into the hopper chamber 501. Additionally, the panel picker 236 can make on-demand adjustments during picking operations. For example, if the panel 192A is picked up off the tabletop 424 but is not pulled into the hopper chamber 501 within a certain period of time, the panel picker 236 can increase the speed of the pneumatic pump 510 in an attempt to pull the panel 192A into the hopper chamber 501.

Figure 7A:
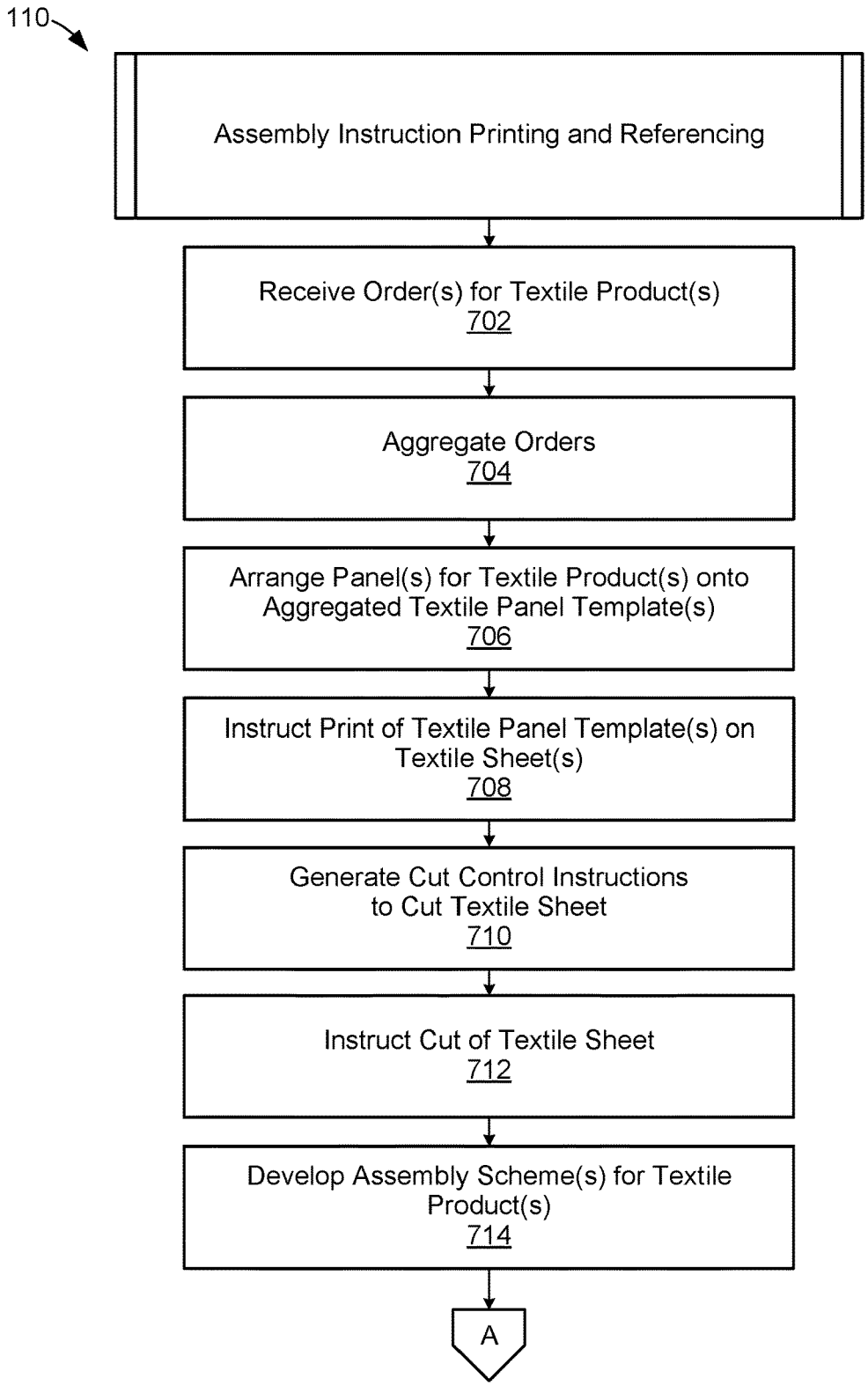
FIG. 7A illustrates an example automated panel printing, cutting, and picking process according to various embodiments of the present disclosure.
Figure 7B:
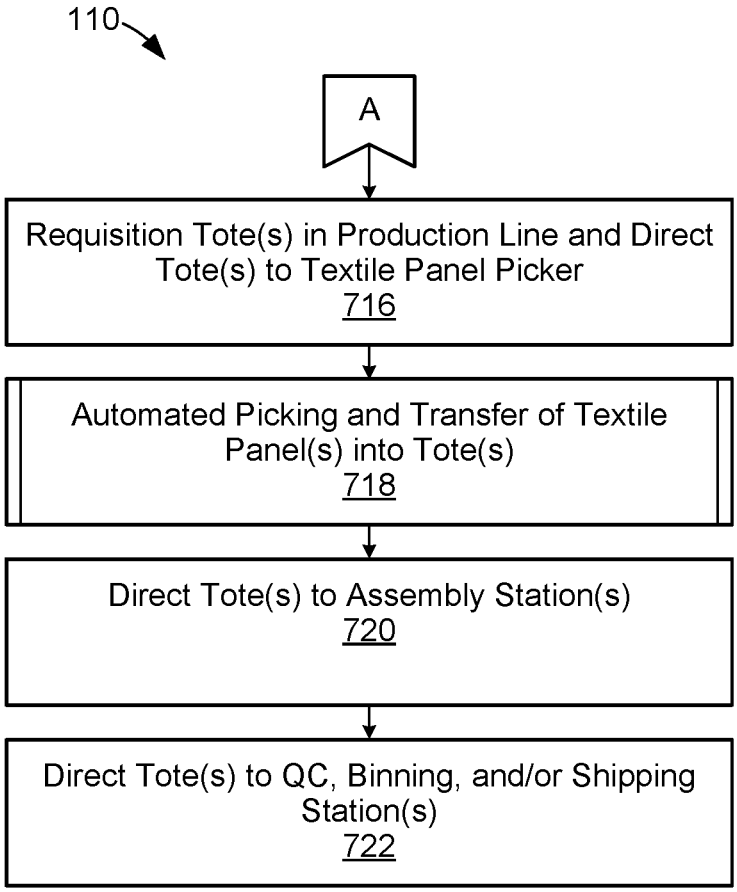
FIG. 7B further illustrates the example automated panel printing, cutting, and picking process in FIG. 7A according to various embodiments of the present disclosure.

Turning to FIGS. 7A and 7B, an example automated panel printing, cutting, and picking process is illustrated. The process can be performed in the networked environment 100 in FIG. 1 according to various embodiments of the present disclosure. In certain aspects, the flowchart shown in FIGS. 7A and 7B may be viewed as depicting an example group of steps performed in the networked environment 100 according to one or more embodiments. It should be appreciated that the flowchart shown in FIGS. 7A and 7B provides merely one example of a functional sequence or arrangement that may be employed to implement the operations of the networked environment 100 described herein. It is noted that, although the process is described in connection with the computing environment 110 shown in FIGS. 1 and 2, other computing environments may perform the process illustrated in FIGS. 7A and 7B.

At reference numeral 702, the process includes the computing environment 110 receiving orders for textile or other products. The orders can be received from the client devices 160 over the network 150 and stored in the apparel manufacturing data store 120. As described herein, the orders may be defined, at least in part, by one or more tech packs 180 received from the client devices 160. At reference numeral 704, the process includes the order aggregator and organizer 210 aggregating the orders for textile products over time. By aggregating orders from various geographic locations and coordinating apparel assembly processes on a relatively large scale, increased efficiency in apparel manufacturing can be achieved.

At reference numeral 706, the process includes the panel arranger 212 arranging panels 192 for textile products into one or more of the aggregated textile panel templates 190. The panels 192 in the aggregated textile panel templates 190 can be representative of one or more sections, portions, or pieces of fabric or other materials for one or more shirts, pants, dresses, or other accessories or items to be manufactured. In one embodiment, when arranging the panels 192, the panel arranger 212 is configured to align the panels 192 to the extent possible among each other to reduce scrap in textile sheets as described herein. Additionally or alternatively, the panel arranger 212 can orient the panels 192 in the textile panel templates 190 to align them with a thread, weave, nap, knit, or print pattern(s) in textile sheets.

At reference numeral 708, the process includes the print engine 132 instructing the textile printer 172 to print the panels 192 for textile products onto one or more textile sheets. Particularly, the process includes the print instructor 214 generating instructions with reference to one or more of the textile panel templates 190 and forwarding those instructions to the textile printer 172 over the network 150. In turn, the textile printer 172 prints the panels 192 for the orders received at reference numeral 702. At reference numeral 708, the process also includes the print instructor 214 coordinating the printing operations of the textile printer 172 over the network 150. In that context, the print instructor 214 can monitor the ongoing printing operations of the textile printer 172 to coordinate those operations with cutting, picking, and/or assembly processes.

At reference numeral 710, the process includes the cut engine 134 generating cut control instructions for the textile cutter 176 to cut out the panels 192 printed at reference numeral 708. Further, at reference numeral 712, the process includes the cut engine 134 instructing the textile cutter 176 to cut the plurality of panels 192 out from the textile sheets over the network 150. Examples of the generation of the cut control instructions and the control of the textile cutter 176 by the cut engine 134 are described in further detail in the '840 application.

At reference numeral 714, the process includes the assembly engine 136 developing one or more assembly schemes for the orders of textile products received at reference numeral 702. The assembly engine 136 can generate the assembly schemes with instructions for the assembly of the panels 192 into one or more textile products. The assembly schemes can be based, at least in part, on information provided in the tech packs 180. Once generated, the assembly schemes can be stored in the apparel manufacturing data store 120 for later reference. The generation of assembly schemes and instructions for the assembly of textile products are described in further detail in the '1640 application.

Turning to FIG. 7B, at reference numeral 716, the process includes the production line coordinator 232 requisitioning one or more totes 194 in the textile production line 178 based in part on the assembly scheme developed at reference numeral 714. For example, depending upon the type of the orders being processed, the production line coordinator 232 may need to requisition one or more totes 194 in the textile production line 178 to transfer the panels 192 to one or more of the assembly stations 196. Further, at reference numeral 716, production line coordinator 232 directs the requisitioned totes 194 to the textile panel picker 177 to receive one or more panels 192 picked by the textile panel picker 177.

At reference numeral 718, the process includes automated picking of one or more of panels 192 and the transfer of those panels 192 into the totes 194. The automated picking process at reference numeral 718 is described in further detail below with reference to FIG. 8.

At reference numeral 720, the process includes the production line coordinator 232 directing the totes 194 to one or more of the assembly stations 196 of the textile production line 178 based on the assembly scheme developed at reference numeral 714. At the assembly stations 196, various textile products can be assembled using the panels 192 in the totes 194. After the textile products are assembled, at reference numeral 722, the process includes the production line coordinator 232 directing the totes 194, including the finished textile products, to one or more of quality control (QC), photography, binning, and/or packing stations. Thus, the assembled textile products can be checked for quality control, photographed for placement in an electronic commerce system, stored in a materials handling area/facility, packaged for shipping, etc.

Figure 8:
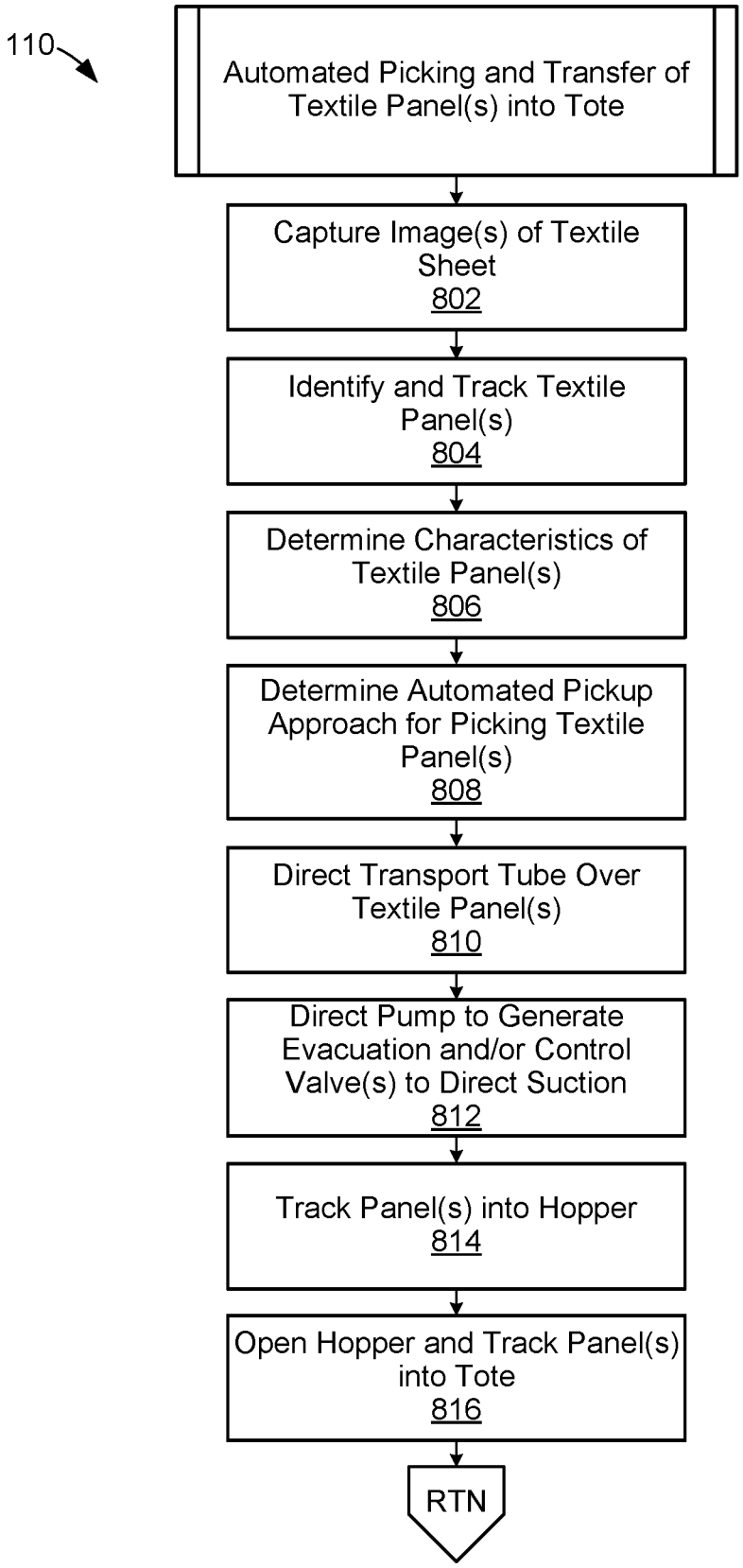
FIG. 8 illustrates an example automated panel picking process used in the process in FIGS. 7A and 7B according to various embodiments of the present disclosure.

FIG. 8 illustrates an example automated panel picking process used in the process in FIGS. 7A and 7B according to various embodiments of the present disclosure. At reference numeral 802, the process includes the panel tracker 234 capturing one or more images of the textile sheet 410 using one or more of the cameras 441-444 and/or the camera head 452. Images (or video) of the textile sheet 410 can be taken at any time during cutting and picking operations as described herein.

At reference numeral 804, the process includes the panel tracker 234 identifying and tracking the panels 192 as they are fed over the tabletop 424 of the textile cutter 176, for example, as described above with reference to FIG. 6B. The panel tracker 234 can perform identification and tracking operations similar to those performed by the image analyzer 220 of the cut engine 134.

At reference numeral 806, the process includes the panel tracker 234 determining one or more characteristics, such as the type, shape, weight and/or size of each of the panels 192 identified at reference numeral 804. For example, the panel picker 236 can estimate the weight or size of each of the panels 192 using image processing techniques to identify the outer boundaries or extents of the panels 192, such as the "X" and "Y" dimensions of the panel 192G shown in FIG. 6B. In some cases, the panel picker 236 can compare the dimensions of certain panels 192 identified from the images with information defined in the textile panel templates 190 used to print the panels 192. Because the textile panel templates 190 can define panel cutouts, cut alignment markers, and other features related to the size of the panels 192, the panel picker 236 can refer to that information to identify and/or confirm the sizes of the panels 192. Further, the apparel manufacturing data store 120 can store the specifications of the textile sheet 410, such as the type, thickness, grade, and other information related to the textile sheet 410. Thus, based on the size of the panels 192 and the grade of the textile sheet 410, among other information, the panel picker 236 can also estimate a weight of the panels 192.

At reference numeral 808, the process includes the panel tracker 234 determining an automated pickup approach for picking the panels 192. An automated pickup approach can include one or more of the selection of a flexible transport tube, such as one of the flexible transport tubes 601-603 shown in FIG. 6A (if multiple tubes are available), the calculation of a level of evacuation necessary to pull the panels 192 through the selected flexible transport tube, and the definition of leading and trailing pickup regions for the evacuation of the panels.

At reference numeral 810, the process includes the panel tracker 234 directing the transport tube transfer arm 450 to position the flexible transport tube 462 (or one of the selected flexible transport tubes 601-603 in FIG. 6A) over one of the panels 192. Once the flexible transport tube 462 has been positioned, the panel picker 236 can direct the pneumatic pump 510 to create suction for the evacuative draw 519 at reference numeral 812. The amount of suction can be determined based on the characteristics of the panels estimated at reference numeral 806. While the pneumatic pump 510 is being directed to create suction, the panel picker 236 can also control one or more valves in the textile panel picker 177 to direct the suction through the flexible transport tube selected at reference numeral 808. The panel picker 236 can also direct the transport tube transfer arm 450 to sweep the flexible transport tube 462 over the panel 192, as necessary, according to the automated pickup approach determined at reference numeral 808 while the suction through the selected flexible transport tube is being generated by the pneumatic pump 510.

At reference numeral 814, the process includes the panel picker 236 tracking one or more of the panels 192 off the tabletop 424 of the textile cutter 176 and into the hopper chamber 501 using the sensors 520-522, the cameras 441-444, and/or the camera head 452. For example, the panel picker 236 can process images captured by the camera head 452 to confirm whether the panels 192 have been picked up off the tabletop 424 of the textile cutter 176. The panel picker 236 can also monitor the sensor 520 to confirm whether the panels 192 have been pulled into the hopper chamber 501. The panel picker 236 can also signal an error under certain circumstances, such as if one of the panels 192A-192J is picked off the tabletop 424 but is not pulled into the hopper chamber 501.

At reference numeral 816, the process includes the panel picker 236 opening the hopper chamber 501 and dropping one or more panels 192 into one or more totes 194 of the textile production line 178. In that way, the panels 192 can be transferred to another location outside of the hopper chamber 501. For example, at the direction of the panel picker 236 and/or the production line coordinator 232, the gates 540 of the textile panel picker 177 can be opened using any suitable mechanism to drop one or more panels 192 out from the textile hopper 464 and into one or more of the totes 194. After the panels 192 have been dropped into the totes 194, the process returns to FIG. 7B, and the production line coordinator 232 can direct the totes to one or more assembly stations 196 on the textile production line 178 at reference numeral 720 in FIG. 7B.

Figure 9:
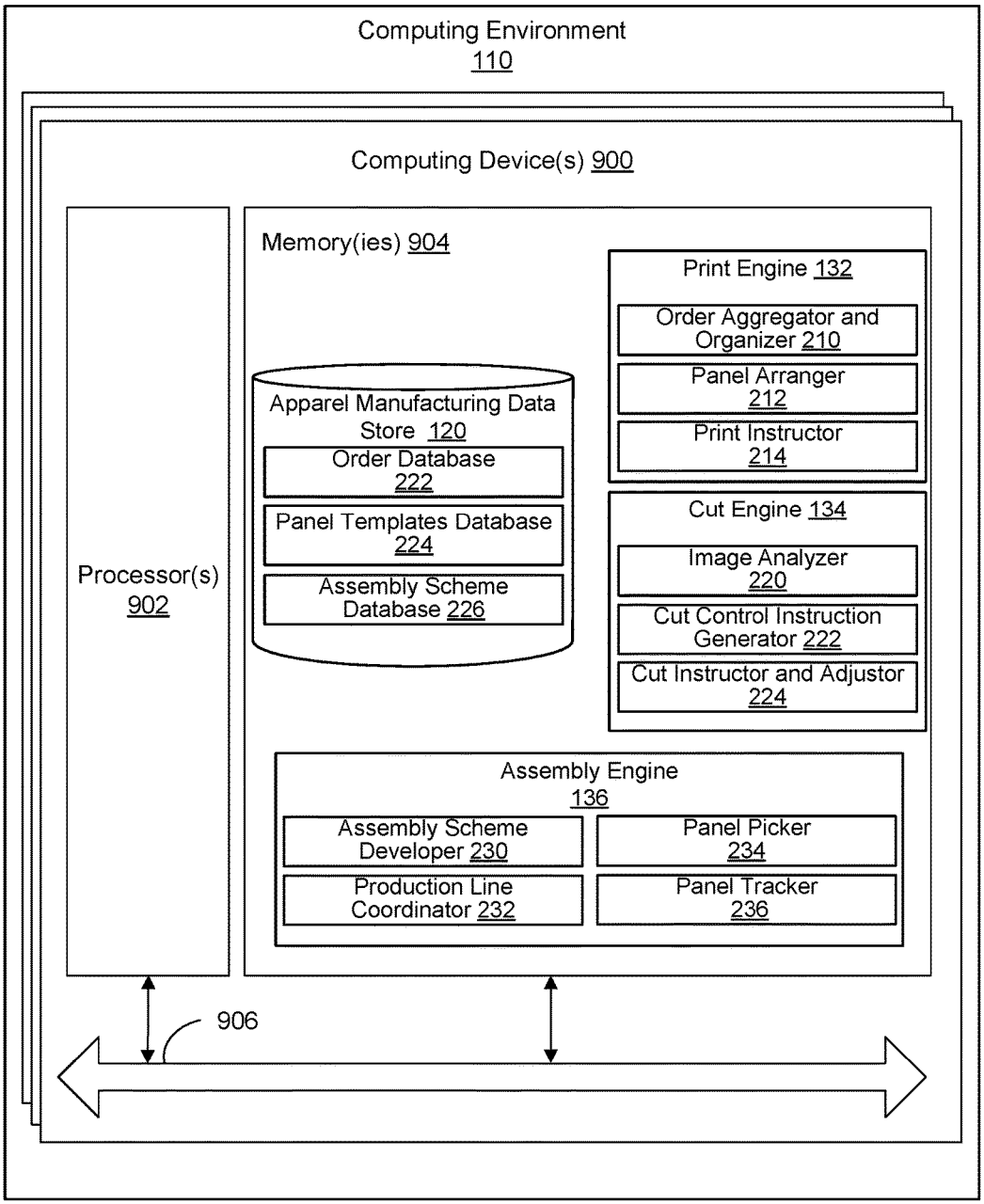
FIG. 9 illustrates an example schematic block diagram of the computing environment employed in the networked environment shown in FIG. 2 according to various embodiments of the present disclosure.

FIG. 9 illustrates an example schematic block diagram of the computing environment 110 employed in the networked environment 100 in FIGS. 1 and 2 according to various embodiments of the present disclosure. The computing environment 110 includes one or more computing devices 900. Each computing device 900 includes at least one processing system, for example, having a processor 902 and a memory 904, both of which are electrically and communicatively coupled to a local interface 906. To this end, each computing device 900 can be embodied as, for example, at least one server computer or similar device. The local interface 906 can be embodied as, for example, a data bus with an accompanying address/control bus or other bus structure as can be appreciated.

In various embodiments, the memory 904 stores data and software or executable-code components executable by the processor 902. For example, the memory 904 can store executable-code components associated with the print engine 132, cut engine 134, and assembly engine 136 for execution by the processor 902. The memory 904 can also store data such as that stored in the apparel manufacturing data store 120, among other data.

It should be understood and appreciated that the memory 904 can store other executable-code components for execution by the processor 902. For example, an operating system can be stored in the memory 904 for execution by the processor 902. Where any component discussed herein is implemented in the form of software, any one of a number of programming languages can be employed such as, for example, C, C++, C#, Objective C, Java®, JavaScript®, Perl, PHP, Visual Basic®, Python®, Ruby, Flash®, or other programming languages.

As discussed above, in various embodiments, the memory 904 stores software for execution by the processor 902. In this respect, the terms "executable" or "for execution" refer to software forms that can ultimately be run or executed by the processor 902, whether in source, object, machine, or other form. Examples of executable programs include, for example, a compiled program that can be translated into a machine code format and loaded into a random access portion of the memory 904 and executed by the processor 902, source code that can be expressed in an object code format and loaded into a random access portion of the memory 904 and executed by the processor 902, or source code that can be interpreted by another executable program to generate instructions in a random access portion of the memory 904 and executed by the processor 902, etc. An executable program can be stored in any portion or component of the memory 904 including, for example, a random access memory (RAM), read-only memory (ROM), magnetic or other hard disk drive, solid-state, semiconductor, or similar drive, universal serial bus (USB) flash drive, memory card, optical disc (e.g., compact disc (CD) or digital versatile disc (DVD)), floppy disk, magnetic tape, or other memory component.

In various embodiments, the memory 904 can include both volatile and nonvolatile memory and data storage components. Volatile components are those that do not retain data values upon loss of power. Nonvolatile components are those that retain data upon a loss of power. Thus, the memory 904 can include, for example, a RAM, ROM, magnetic or other hard disk drive, solid-state, semiconductor, or similar drive, USB flash drive, memory card accessed via a memory card reader, floppy disk accessed via an associated floppy disk drive, optical disc accessed via an optical disc drive, magnetic tape accessed via an appropriate tape drive, and/or other memory component, or any combination thereof. In addition, the RAM can include, for example, a static random access memory (SRAM), dynamic random access memory (DRAM), or magnetic random access memory (MRAM), and/or other similar memory device. The ROM can include, for example, a programmable read-only memory (PROM), erasable programmable read-only memory (EPROM), electrically erasable programmable read-only memory (EEPROM), or other similar memory device.

Also, the processor 902 may represent multiple processors 902 and/or multiple processor cores and the memory 904 may represent multiple memories that operate in parallel, respectively, or in combination. Thus, the local interface 906 can be an appropriate network or bus that facilitates communication between any two of the multiple processors 902, between any processor 902 and any of the memories 904, or between any two of the memories 904, etc. The local interface 906 can include additional systems designed to coordinate this communication, including, for example, a load balancer that performs load balancing. The processor 902 can be of electrical or of some other available construction.

As discussed above, the print engine 132, the cut engine 134, and the assembly engine 136 may be embodied, in part, by software or executable-code components for execution by general purpose hardware. Alternatively the same may be embodied in dedicated hardware or a combination of software, general, specific, and/or dedicated purpose hardware. If embodied in such hardware, each can be implemented as a circuit or state machine, for example, that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowcharts or process diagrams of FIGS. 7A, 7B, and 8 are representative of certain processes, functionality, and operations of embodiments discussed herein. Each block may represent one or a combination of steps or executions in a process. Alternatively or additionally, each block may represent a module, segment, or portion of code that includes program instructions to implement the specified logical function(s). The program instructions may be embodied in the form of source code that includes human-readable statements written in a programming language or machine code that includes numerical instructions recognizable by a suitable execution system such as the processor 902. The machine code can be converted from the source code, etc. Further, each block may represent, or be connected with, a circuit or a number of interconnected circuits to implement a certain logical function or process step.

Although the flowcharts or process diagrams of FIGS. 7A, 7B, and 8 illustrate a specific order, it is understood that the order can differ from that which is depicted. For example, an order of execution of two or more blocks can be scrambled relative to the order shown. Also, two or more blocks shown in succession in FIGS. 7A, 7B, and 8 can be executed concurrently or with partial concurrence. Further, in some embodiments, one or more of the blocks shown in FIGS. 7A, 7B, and 8 can be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the print engine 132, the cut engine 134, and the assembly engine 136 that are embodied, at least in part, by software or executable-code components, may be embodied or stored in any tangible or non-transitory computer-readable medium or device for execution by an instruction execution system such as a general purpose processor. In this sense, the logic may be embodied as, for example, software or executable-code components that can be fetched from the computer-readable medium and executed by the instruction execution system. Thus, the instruction execution system can be directed by execution of the instructions to perform certain processes such as those illustrated in FIGS. 7A, 7B, and 8. In the context of the present disclosure, a "computer-readable medium" can be any tangible medium that can contain, store, or maintain any logic, application, software, or executable-code component described herein for use by or in connection with an instruction execution system.

The computer-readable medium can include any physical media such as, for example, magnetic, optical, or semiconductor media. More specific examples of suitable computer-readable media include, but are not limited to, magnetic tapes, magnetic floppy diskettes, magnetic hard drives, memory cards, solid-state drives, USB flash drives, or optical discs. Also, the computer-readable medium can include a RAM including, for example, an SRAM, DRAM, or MRAM. In addition, the computer-readable medium can include a ROM, a PROM, an EPROM, an EEPROM, or other similar memory device.

Disjunctive language, such as the phrase "at least one of X, Y, or Z," unless specifically stated otherwise, is to be understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to be each present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A system, comprising:

a textile cutter including a tabletop upon which a textile panel can be cut out from a textile sheet;

a textile panel picker, comprising:

a flexible pneumatic transport tube;

a transport tube transfer arm configured to position a first distal end of the flexible pneumatic transport tube at a location over the tabletop;

a textile hopper at a second distal end of the flexible pneumatic transport tube; and a pneumatic pump assembly configured to evacuate air from the textile hopper and through the flexible pneumatic transport tube; and at least one computing device configured to perform operations comprising:

identifying the textile panel on the tabletop;

directing the transport tube transfer arm to position the first distal end of the flexible pneumatic transport tube over the textile panel;

determining an amount of suction to pull the textile panel through the flexible pneumatic transport tube based at least in part on a characteristic of the textile panel; and directing the pneumatic pump assembly to generate the amount of suction.

2. The system of claim 1, wherein the textile hopper further comprises:

a sensor to detect a presence of the textile panel in the textile hopper; and a gate to release the textile panel out from within the textile hopper.

3. The system of claim 1, wherein the operations further comprise:

determining a leading pickup region of the textile panel based at least in part on a characteristic of the textile panel; and directing the transport tube transfer arm to position the first distal end of the flexible pneumatic transport tube over the leading pickup region of the textile panel.

4. A method, comprising:

capturing, by at least one computing device, an image of a textile sheet, the image including a textile panel on the textile sheet;

instructing, by the at least one computing device, a textile cutter to cut the textile panel out from the textile sheet;

identifying, by the at least one computing device, the textile panel on a tabletop of the textile cutter;

estimating, by the at least one computing device, at least one of a weight or a size of the textile panel based at least in part on a panel cutout boundary of the textile panel;

determining, by the at least one computing device, a pickup location for automated picking of the textile panel based at least in part on a characteristic of the textile panel;

determining, by the at least one computing device, an amount of suction to pull the textile panel through a flexible pneumatic transport tube based at least in part on the characteristic of the textile panel; and directing, by the at least one computing device, the flexible pneumatic transport tube to the pickup location, the flexible pneumatic transport tube configured to pick the textile panel off the tabletop using the amount of suction.

5. The method of claim 4, further comprising selecting, by the at least one computing device, one of a plurality of flexible pneumatic transport tubes to pick the textile panel off the tabletop.

6. The method of claim 4, wherein the characteristic of the textile panel comprises at least one of a weight or a size of the textile panel.

7. The method of claim 4, further comprising directing, by the at least one computing device, a pneumatic pump assembly to generate the amount of suction to pull the textile panel through the flexible pneumatic transport tube.

8. The method of claim 7, further comprising controlling, by the at least one computing device, at least one valve to direct the amount of suction through the flexible pneumatic transport tube.

9. The method of claim 8, further comprising:

tracking, by the at least one computing device, the textile panel from the tabletop, through the flexible pneumatic transport tube, and into the textile hopper; and transferring, by the at least one computing device, the textile panel out from textile hopper.

10. A system, comprising:

a textile panel picker, comprising:

a flexible pneumatic transport tube;

a transfer apparatus configured to position a first distal end of the flexible pneumatic transport tube;

a textile hopper at a second distal end of the flexible pneumatic transport tube; and a pneumatic pump assembly configured to evacuate air from the textile hopper and through the flexible pneumatic transport tube; and at least one computing device communicatively coupled to the textile panel picker and configured to perform operations comprising:

directing the transfer apparatus to position the first distal end of the flexible pneumatic transport tube over a textile panel;

determining an amount of suction to pull the textile panel through the flexible pneumatic transport tube based at least in part on a characteristic of the textile panel; and directing the pneumatic pump assembly to generate the amount of suction.

11. The system of claim 10, wherein the pneumatic pump assembly comprises a pressure relief valve, a pneumatic pump, and a dust agitator.

12. The system of claim 10, wherein the textile hopper further comprises:

a sensor to detect a presence of the textile panel in the textile hopper; and a release mechanism to release the textile panel out from within the textile hopper.

13. The system of claim 10, wherein the operations further comprise:

capturing an image of a textile sheet, the textile sheet including a plurality of textile panels for a textile product;

identifying the plurality of textile panels using the image; and tracking the plurality of textile panels.

14. The system of claim 13, wherein the operations further comprise:

directing the textile panel picker to transfer the plurality of textile panels into the textile hopper; and transferring the plurality of textile panels out from the textile hopper.

15. The system of claim 10, wherein the operations further comprise:

estimating a characteristic of the textile panel based at least in part on a panel cutout boundary of the textile panel;

determining a pickup path for picking the textile panel based at least in part on the characteristic of the textile panel; and directing the transfer apparatus to move the first distal end of the flexible pneumatic transport tube along the pickup path over the textile panel.

16. The system of claim 10, wherein the flexible pneumatic transport tube comprises a plurality of flexible pneumatic transport tubes each of a respective different diameter.

17. The system of claim 16, wherein the operations further comprise selecting one of the plurality of flexible pneumatic transport tubes based at least in part on a characteristic of the textile panel.

18. The system of claim 17, wherein the operations further comprise:

controlling at least one valve in the textile panel picker to direct the amount of suction through the one of the plurality of flexible pneumatic transport tubes.

19. The system of claim 10, wherein the operations further comprise:

tracking the textile panel through the flexible pneumatic transport tube and into the textile hopper;

directing a tote along a conveyor; and transferring the textile panel from the textile hopper into the tote.

* * * * *